US009599441B2

(12) United States Patent
Stocke, Jr.

(10) Patent No.: US 9,599,441 B2
(45) Date of Patent: Mar. 21, 2017

(54) OFF-BOARD INFLUENCE SYSTEM

(71) Applicant: William R Stocke, Jr., Bloomington, IN (US)

(72) Inventor: William R Stocke, Jr., Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 652 days.

(21) Appl. No.: 14/021,202

(22) Filed: Sep. 9, 2013

(65) Prior Publication Data

US 2014/0070977 A1 Mar. 13, 2014

Related U.S. Application Data

(60) Provisional application No. 61/698,435, filed on Sep. 7, 2012.

(51) Int. Cl.

| | |
|---|---|
| ***F41J 2/00*** | (2006.01) |
| ***H01Q 17/00*** | (2006.01) |
| ***H01Q 15/14*** | (2006.01) |
| ***H01Q 1/34*** | (2006.01) |
| ***H01Q 1/36*** | (2006.01) |

(52) U.S. Cl.

CPC ..... *F41J 2/00* (2013.01); *H01Q 1/34* (2013.01); *H01Q 1/36* (2013.01); *H01Q 15/14* (2013.01); *H01Q 17/00* (2013.01)

(58) Field of Classification Search

CPC ..... F41J 2/00–2/02; H01Q 1/34; H01Q 15/14–15/22; H01Q 1/36; H01Q 17/00–17/008

See application file for complete search history.

(56) References Cited

U.S. PATENT DOCUMENTS

| | | | | |
|---|---|---|---|---|
| 4,695,841 | A * | 9/1987 | Billard | H01Q 15/18 342/8 |
| 6,286,155 | B1 | 9/2001 | Handwerker | |
| 8,022,857 | B2 * | 9/2011 | Carcone | H01Q 1/04 342/10 |
| 8,253,639 | B2 * | 8/2012 | Cohen | H01P 1/20 343/753 |
| 9,166,302 | B2 * | 10/2015 | Cohen | H01Q 21/205 |

OTHER PUBLICATIONS

Saville, P. *Review of Radar Absorbing Materials* (*Analyse des matériaux absorbant les orides radar*), RDDC Atlantique TM 2005-003, 2005 (63 pages).

* cited by examiner

*Primary Examiner* — Matthew M Barker
(74) *Attorney, Agent, or Firm* — Chrisopher A. Monsey

(57) ABSTRACT

An influence system including open cell structures with one or more fractal reflective or resonating structures, wherein the fractal reflective or resonating structures are adapted to produce an emitted reflective or resonance signal that approximately matches a target electromagnetic signal reflection or resonance profile comprising a plurality of electromagnetic signal characteristics, said plurality of electromagnetic signal characteristics, a tow yoke coupled to one end of said blanket comprising a floatation chamber section, a tow cable adapted to tow said tow yoke and blanket, said tow cable comprising a low electromagnetic observable material or having a radar absorptive material coating.

43 Claims, 28 Drawing Sheets

OFF-BOARD INFLUENCE SYSTEM

CROSS-REFERENCE TO RELATED APPLICATIONS

The present application claims priority to U.S. Provisional Patent Application Ser. No. 61/698,435, filed Sep. 7, 2012, entitled "OFF-BOARD INFLUENCE SYSTEM," the disclosure of which is expressly incorporated by reference herein.

STATEMENT REGARDING FEDERALLY SPONSORED RESEARCH OR DEVELOPMENT

The invention described herein was made in the performance of official duties by an employee of the Department of the Navy and may be manufactured, used and licensed by or for the United States Government for any governmental purpose without payment of any royalties thereon.

BACKGROUND AND SUMMARY

The present invention relates to an off-board electromagnetic or other wave energy systems, such as Radio Frequency (RF) systems, designed to provide vehicle-towable RF emitter adapted for use in RF systems, to be used in altering or influencing biologic entities such as whales or other types of receiving sensor systems or mobile tracking systems, such as those operated by pirates, simulators, intelligent agent game systems, or other types of gaming systems such as gaming consoles, by providing numerous artificially enhanced radar returns to the mobile tracking systems. Whales and other biologic entities may be influenced by interaction systems which can produce a desired behavior or deter an undesired behavior which may subject such an entity to harm or cause harm to another entity. Similarly, other entities can be influenced to deter or encourage a behavior using this system. For example, a school of fish can be influenced using this system as well as birds, herds of deer, or even insects. A variety of spectrum or emission systems can be used including acoustic as well as other electromagnetic spectrum systems which can interact with entities adapted to receive such emissions. Alternatively, the system could be used to enhance radar returns for aircraft landing at airfields or to provide for air vehicles which could be used to assist pilots in avoiding dangerous conditions such as thunderstorms, mountains, or environmental conditions such as wind shear based on monitoring of unmanned aerial vehicles which tow a platform made with an embodiment of the invention. Reflective qualities of an enhanced material or structure created according to one embodiment of the invention could provide civil aircraft radar better ability to identify and locate aviation facilities during inclement weather situations such as severe thunderstorms or snowstorms, where the electromagnetic environment may be obscured by dense rain or snow, and where the reflective properties of this system may enable the pilot or radar operator to identify physical features of the aerodrome being sought. Another use can be for ship navigation in stormy weather where an embodiment of the invention can be deployed to assist ships in navigation by providing high EM reflectivity structures which can be maneuvered by a tow system to influence vessel navigation. The system can also provide an ability for ships transiting high piracy waters to influence pirates to alter course towards or away from influence system (IS) embodiments including by simulating behavior of escort ships to induce pirate ships to alter course and move away from an area of interest.

Existing systems require significant labor and logistics support. Environmental factors such as weather or surface conditions (e.g., sea, land, air, space) including gaming environments (e.g., wind, gravity, weather, temperature), can create a significant challenge for maintenance or realistic interactions and reliability or reproduction of desired interactions with a biologic entity or mobile tracking systems of a more real world experience in a gaming environment or other environments. Advantages include ability for easy fielding, use, maintenance, etc.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1A:
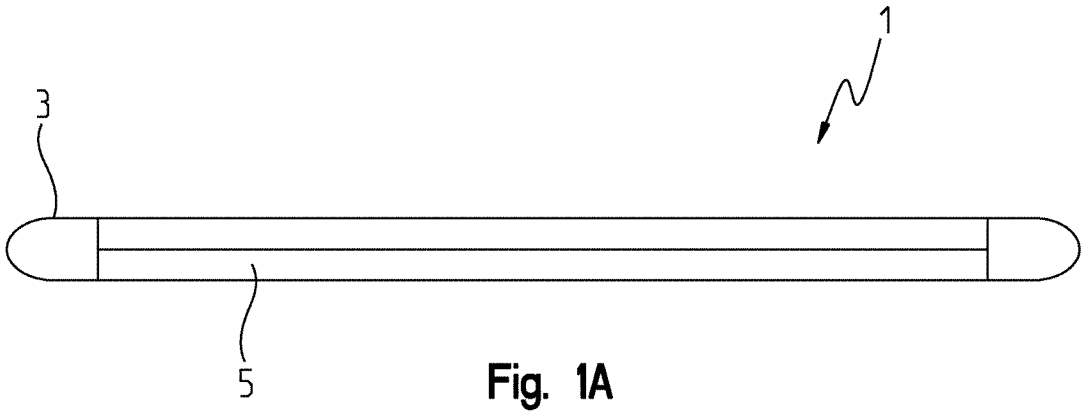
FIGS. 1A and 1B are an exemplary IS having a blanket or sheet planar structure with fractal or radio frequency or electromagnetic energy reflecting or resonating structures.

The embodiments of the invention described herein are not intended to be exhaustive or to limit the invention to precise forms disclosed. Rather, the embodiments selected for description have been chosen to enable one skilled in the art to practice the invention.

Referring initially to FIG. 1, an exemplary IS assembly 1 is provided having a two layer open cell IS blanket or sheet/planar structure 5 (hereinafter "blanket" 5) formed with fractal or RF/EM reflective or resonating structures with an aluminum sheet sandwiched between is provided. Additional features such as RF identification device (RFID) systems (not shown) can also be formed into the blanket 5. Length and width of the blanket will be determined by the desired reflective or resonance signal from a wave signal impinging on the blanket. A tow yoke 3, such as a structure made from injection molded plastic, is attached to one or both ends of the blanket allowing for tow force distribution, and can include a floatation chamber section. A second tow yoke 3' can be coupled to an opposing end of the blanket 5 and be adapted to enable "daisy-chaining" of IS assemblies 1 comprising an exemplary IS blanket. The exemplary blanket 5 can be formed with air cells for flotation augmented with fractal designs such as the Koch Curve and/or dipole chaff to enhance RF return. Internal longitudinal and lateral stiffeners (not shown) can be added to provide rigidity to the blanket 5. Alternatively, the blanket can be inflated by a gas source (not shown), such as an airbag inflation device, which can be activated when a predetermined frequency/pattern is detected by a communication device mounted on the IS assembly 1 or can be remotely controlled either through a direct connection through a line coupled with the tow cable 2 (not shown) or by EM transceiver to a controller (not shown) to provide deployment and/or a desired form. One embodiment can include a tow cable comprising a low electromagnetic observable material or having a radar absorptive material coating.

The FIG. 1 IS blanket 5 can be formed with an array of fractal antenna sections (e.g., Peano-Gosper fractal array). An embodiment of the blanket 5 can be formed with irregular but self-similar, repeated fractal-shaped unit sections, which cover an entire plane of the blanket. An embodiment of the repeated fractal-shaped unit sections comprise an outer boundary contour of the array built of fractal unit sections that follows a fractal distribution to create a modular array adapted to produce phased and other types of beamforming effects of resonated wave energy in a particular direction of interest or orientation (e.g., from 5-30 degrees) from the face of the blanket 5.

Type of fractal antenna used in an exemplary IS blanket 5 can include microstrip antennas designed to resonate at specific frequency ranges, e.g., at UHF and higher frequencies. An exemplary microstrip or other fractal antenna size is determined based on one or more identifying wave energy, e.g., EM, signals from sources emitted or received from or by one or more source entities that are to have behavior influenced in a predetermined way such that the fractal antenna(s) (including beamforming phased array resonance based arrays) are determined based on wavelength at a resonant frequency of one or more such source entities.

An IS blanket 5 embodiment can be formed with different types of phased arrays, also called beamformers, including time domain beamformers and frequency domain beamformers. A time domain beamformer structure is based on time-based operations such as "delay and sum". Such an exemplary structure delays an incoming signal from each array element by a certain amount of time, and then adds them together. Sometimes a multiplication with a window across the array is done to increase a mainlobe/sidelobe ratio, and to insert zeroes in the characteristic. Embodiments can include one or more different types of frequency domain beamformers such as one that separates different frequency components that are present in a received signal into different frequency bins (using either an FFT or a filterbank). When different delay and sum beamformers are applied to each frequency bin, it is possible to point the main lobe to different directions for different frequencies. This can be an advantage for communication links. Another embodiment can also include a frequency domain beamformers which is structured to resonate/reflect signals of interest based on spatial frequency. This means that an FFT is taken across the different array elements, not in time. In one embodiment, an output of an N point FFT are N channels, which can be evenly divided in space. This approach employs several beamformers at the same time possible.

An alternative exemplary IS blanket 5 can also include a phased array including an array of antennas in which the relative phases of the respective signals produced by resonance or reflectance from fractal antennas is coupled with active emitters where the active emitters and passive fractal antennas combined and are varied in such a way that the effective radiation pattern of the array is reinforced in a desired direction and suppressed in undesired directions.

The IS blanket 5 design can alternatively include a high gain fractal antenna array in a low-profile antenna structure. Two or three dimensional fractal structures or arrays can also be used. Fractal antennas used with the invention can include an array of patch antennas in a phased array of antennas with dynamic beamforming ability. Another type of fractal antenna that can be used with the IS blanket 5 includes a Planar Inverted F Antenna (PIFA). Additional antenna types that an IS blanket can be formed with include microstrip or patch antennas designed to have vertical, horizontal, right hand circular (RHCP) or left hand circular (LHCP) polarizations. In addition, EM wave emitters, e.g., phased array transmitter elements, can be added to a passive IS blanket structure using multiple feed points, or a single feedpoint with asymmetric or symmetric fractal antennas or patch structures to provide additional phased array beam forming and/or directional control.

Figure 1B:
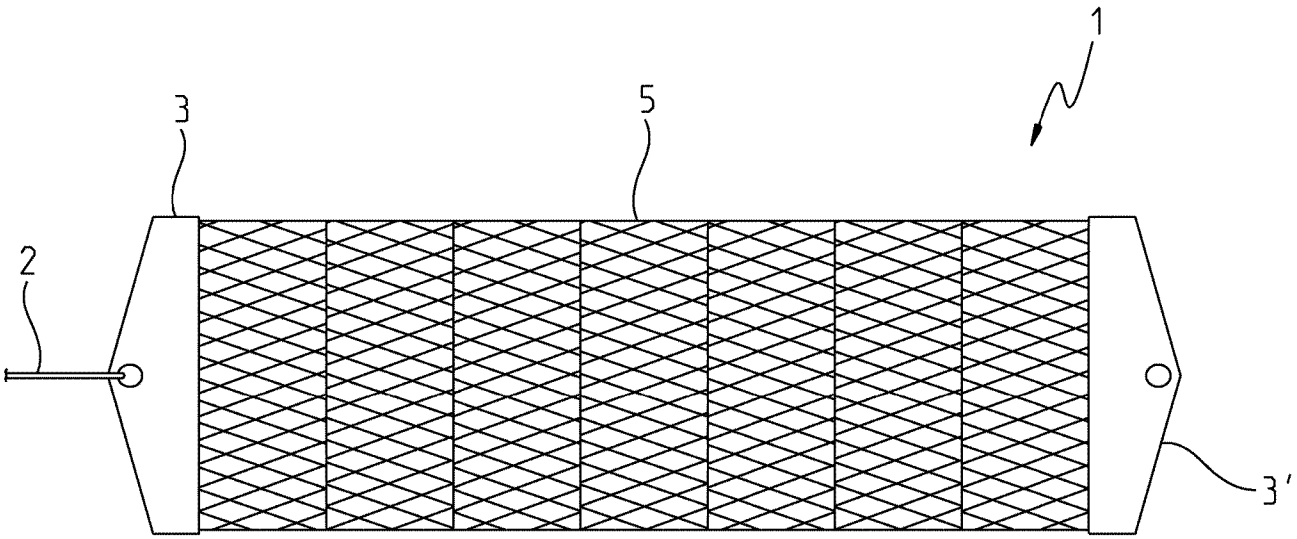

The IS 1 of FIGS. 1A and 1B can also be modified to mount acoustic deterrence system (not shown) which are controlled by a control system (not shown). One or more ruggedized transducers/projectors (not shown) can be attached to the IS 1 which can include ceramic elements that radiate on plurality of frequencies and intensities, e.g., an axis source level of ~200 dB at both 210 kHz and 225 kHz, or producing a narrow directional beam width of about six or more degrees. A sound sensor system (not shown) can be mounted on the IS 1 that is adapted to detect acoustical patterns associated with different marine life which is desired to be deterred from being in the vicinity of the IS 1 or in a path or transmission axis of the IS 1. The control system (not shown) could be adapted to control emissions from the transducers or projectors to project acoustic energy at a frequency and intensity which exploits the best hearing ability of the detected marine mammal or life. Emissions from the transducer or projectors, including parametric projectors, can be matched with sound patterns which cause the targeted mammals to avoid the IS or the transmission axis such as sound made by predators, alarm or distress sounds which cause such mammals or sea life to move away from an area, or other sounds which deter the detected marine mammal or life. The transducers or projectors can be designed to project a stable narrow beam of sound just under the surface of the water for desired distances e.g., up to 150 meters. Low power settings and high directionality can avoid cumulative or harmful noise effects to detected/deterred mammal or seal life. The IS system can be adapted to warn or deter whales traveling near the surface who cannot hear the sounds of ships due to the confluence of acoustical shadowing and Lloyd's Mirror Effect. An acoustic version of the IS 1 can selectively fill-in acoustic shadows in relation to a ship e.g., ahead of ships (with a remotely controlled unmanned vessel or an unmanned), with modulated noise which could match sounds found in nature and which cause such sea life or mammals to avoid or steer away from a desired deterrence area. Such acoustic IS systems can include a Tonpliz array and a modified parametric array. A solar panel or other power source can be coupled to the IS assembly 1 to power the acoustic system.

Figure 2:
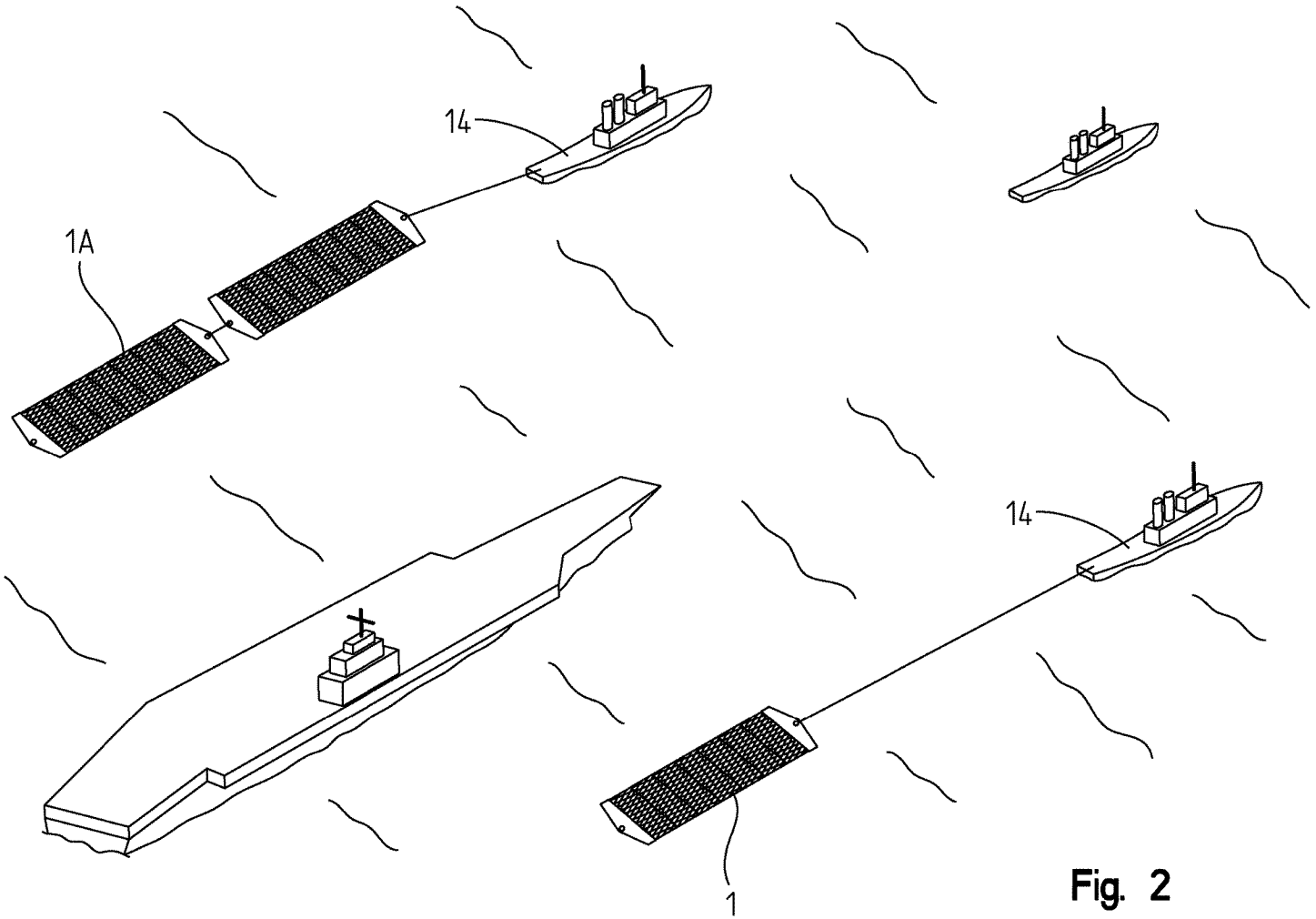
FIG. 2 shows an exemplary IS including an IS blanket towed behind a ship.

FIG. 2 shows an exemplary IS 1 including an IS blanket 5 (e.g., see FIG. 1) towed behind a ship 14. A daisy-chained IS assembly 1A is also shown being towed behind a ship 14. On embodiment of an IS in accordance with the invention is can be installed and stowed aboard moveable platforms such as a sea vessel. An exemplary IS assembly 1 could be mounted astern fastened to the ship's aft deck area on a winch/reel deployment and retrieval system (not shown). One operational concept is for the IS assembly 1 (or, e.g., 1A) to be deployed and towed flat on a sea surface by a vessel 14 in order to provide additional wave energy systems, e.g., electromagnetic (EM) (e,g, radar) or acoustic (e.g., sonar, piezoelectric transmitter, etc) returns that influence entities which receive wave energy (such as radar systems, mobile tracking systems, navigation systems, electro-optics, bats, whales, dolphins, radar systems, etc). Tandem linkage of an exemplary IS in "daisy-chain" fashion (e.g., 1A) can also be done and thus enabling on-the-fly scalability.

Figure 3:
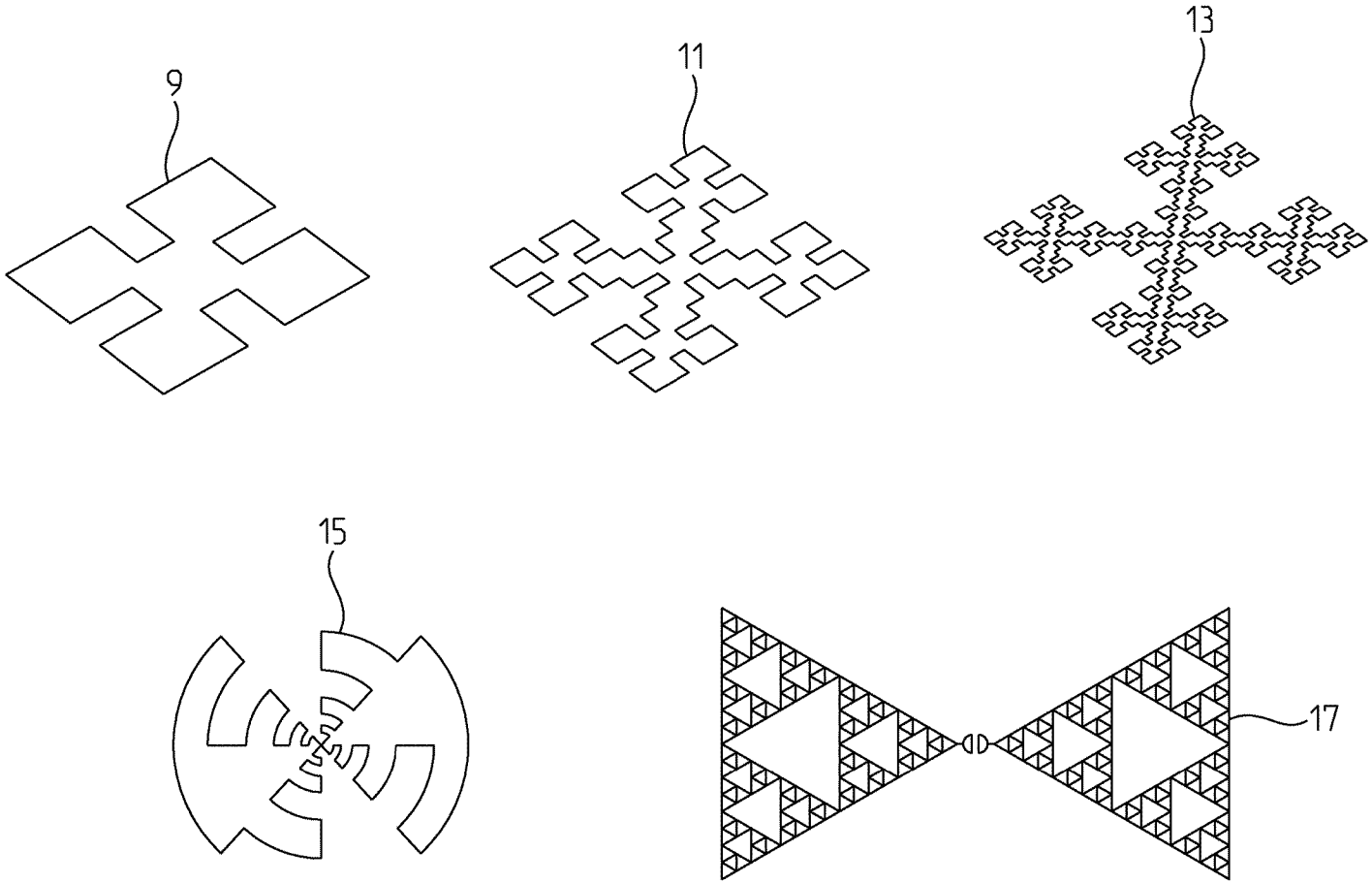
FIG. 3 shows fractal loop antennas with structures adapted to produce different resonant frequencies.

Referring to FIG. 3, simple shaped fractal loop antennas (e.g., 9, 11, 13, 15, 17) are shown with structures adapted to produce different resonant frequencies. Each iteration or different fractal design can produce a different resonant frequency.

Figure 4:
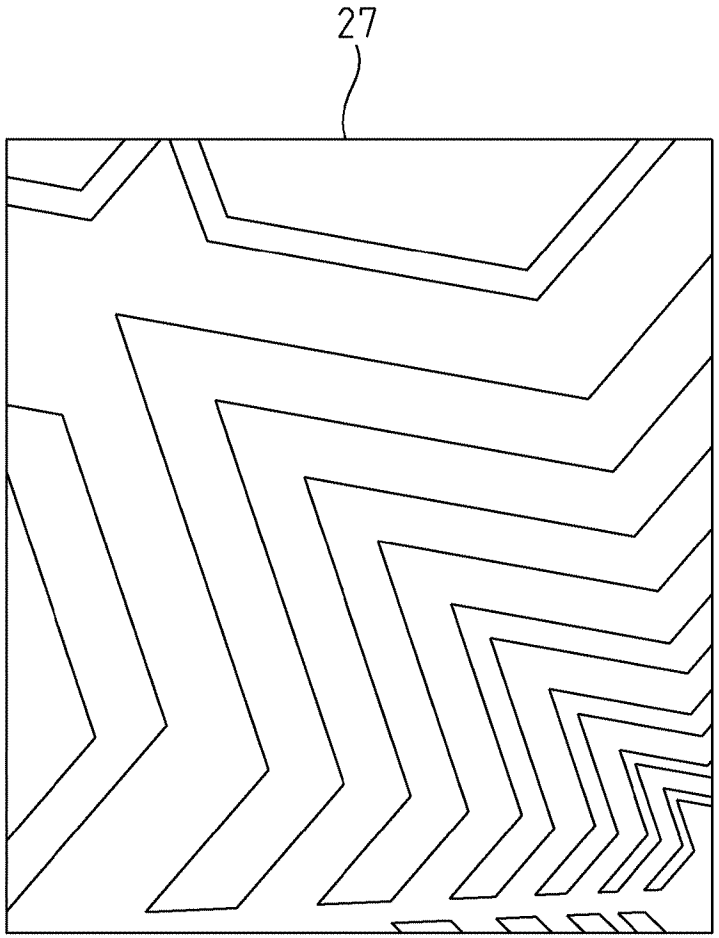
FIG. 4 shows another exemplary fractal antenna which includes a portion of a fractalized wideband antenna.
Figure 5:
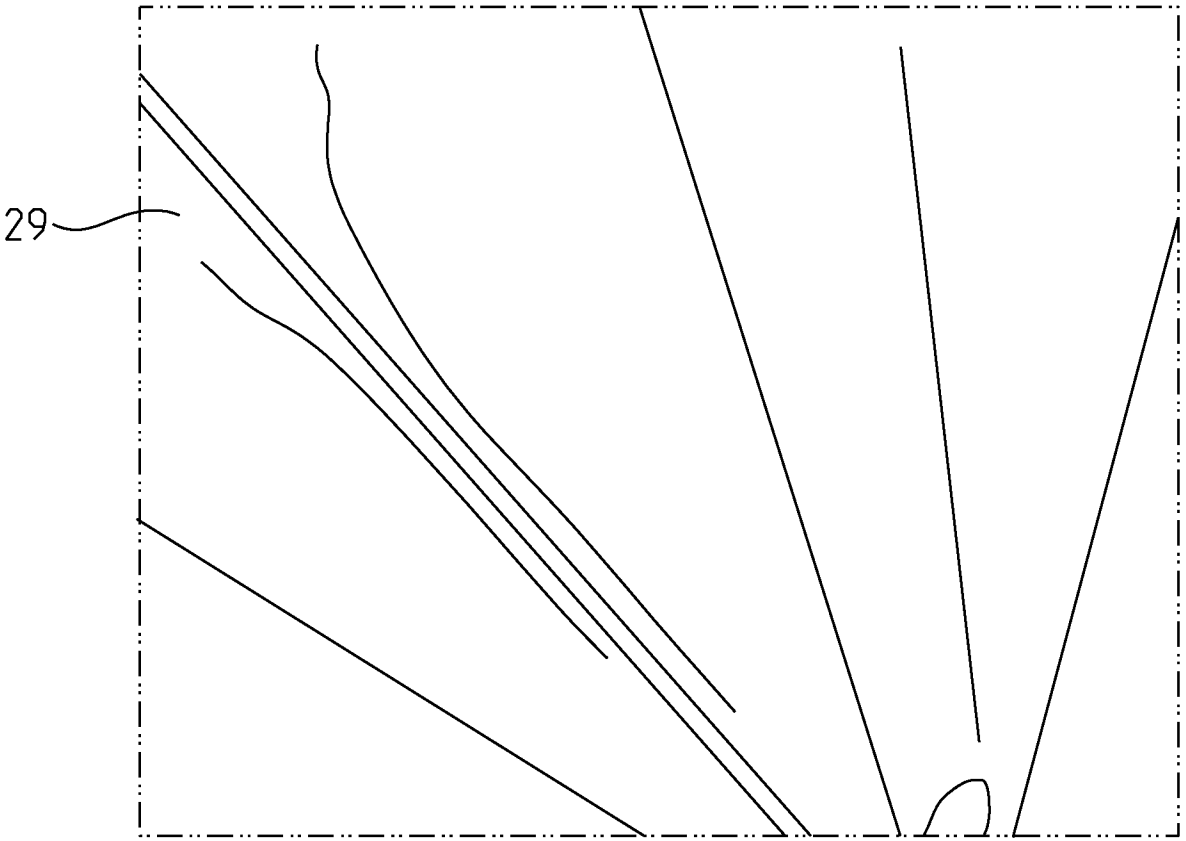
FIG. 5 shows another exemplary fractal antenna which includes a portion of a fractalized wideband dipole antenna.

One embodiment of the invention can include fractal surfaces or internal structures in the blanket. Fractal loading, which uses bends, or holes, over a variety of size scales to emulate the effects of discrete inductors and capacitors. Blankets can be formed based on shaping as a substitute for discrete components which includes tuned micro-strip antennas, meander line antennas, and coil antennas. Blankets can be formed with resonating antenna shapes such as RF identification (RFID) structures which produce specific returns based on specific types of wave energy (also usable to provide coded identification signals e.g. for search and rescue, navigation reference points, discrete object identification, etc). Blanket structures can be formed to provide broadband and multiband frequency response that derives from the inherent properties of the fractal geometry of a desired antenna. Fractal structures built into a blanket (e.g., FIG. 1, 5) can be desired to reflect or emit particular multi-frequency characteristics containing specified stop bands as well as specific multiple bands. A shaped fractal antenna can provides desired radiating LC circuit. As a fractal design is "iterated" the complexity of the shape increases and resulting loading causes multiple resonances and a shifting down in frequency. Referring to FIG. 4, another exemplary fractal antenna 27 is shown which includes a portion of a fractalized wideband antenna. Referring to FIG. 5, another exemplary fractal antenna 29 is shown which includes a portion of a fractalized wideband dipole antenna.

Figure 6:
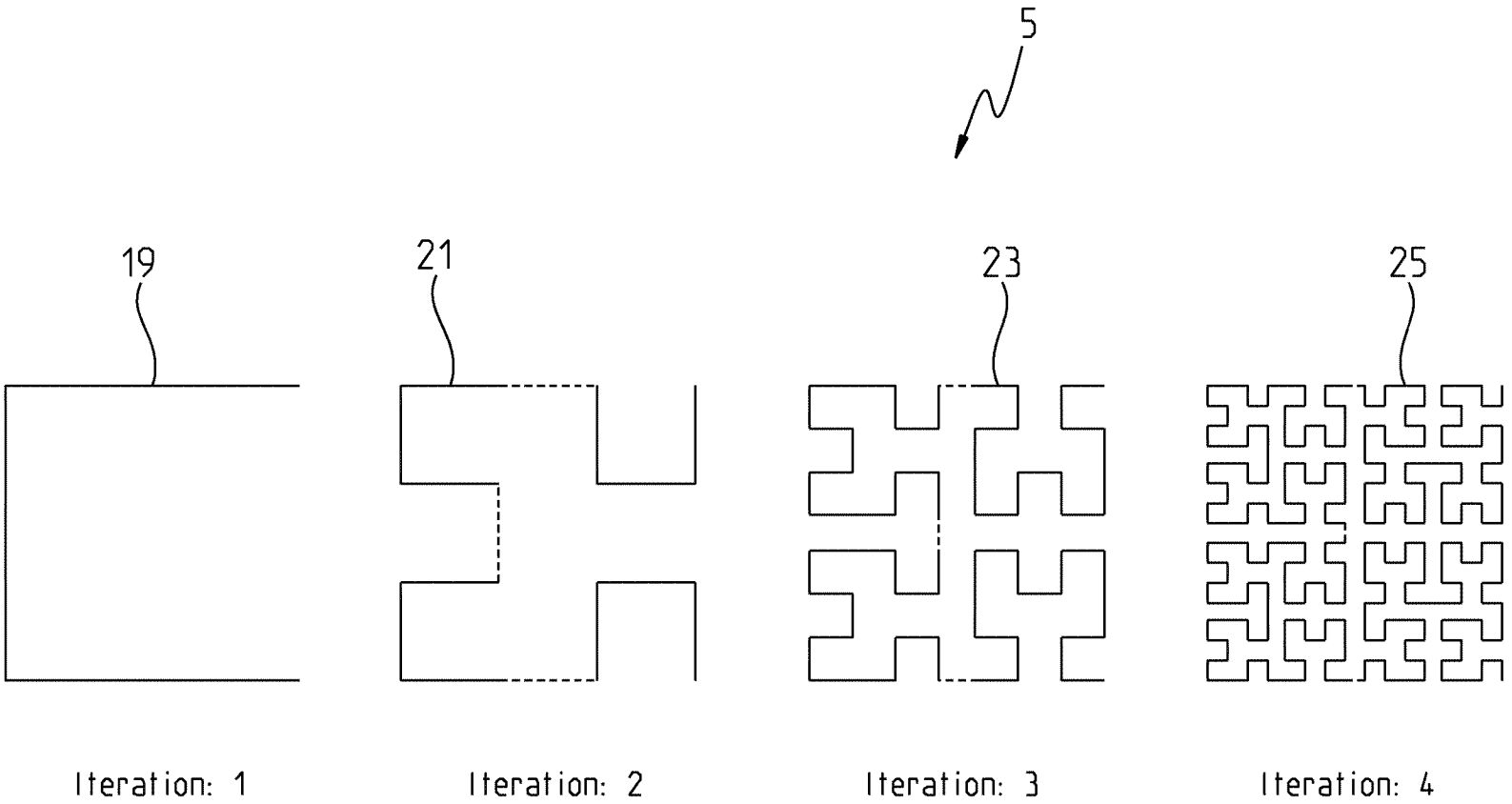
FIG. 6 shows an aspect of the invention which can also use a variety of fractal antennas such as a Hilbert Curve Fractal antenna.

Referring to FIG. 6, an aspect of the invention can also use a variety of fractal antennas such as a Hilbert Curve Fractal antenna. A first 19, second 21, third 23, and fourth 25 iteration of a fractal with Hilbert Curve geometry is shown. For example, a half-wave meander line antenna can be resonant when its arms are approximately a quarter wavelength long. A biconical antenna provides a broadband variant for a dipole antenna. A biconical antenna can be fabricated with wires along its periphery. Another possible antenna can include a Sierpinski gasket fractal antenna with multi-band radiation characteristics. A conventional coplanar waveguide (CPW) on a dielectric substrate consists of a center strip conductor with semi-infinite ground planes on either side. A CPW antenna can provide certain advantages over microstrip line antennas such as simplified fabrication which facilitates shunt as well as series surface mounting of active and passive devices eliminates the need for via holes and reduction of radiation loss. In addition a ground plane exists between two adjacent lines; hence cross talk effects between them are reduced and hence improve circuit or structure density.

The Koch snowflake (also known as the Koch star and Koch island) is a mathematical curve based on the Koch curve, which includes a continuous curve without tangents constructed from elementary geometric shapes. A Koch fractal snowflake can be constructed by starting with an equilateral triangle then recursively altering each line segment such as: First, divide a line segment into three segments of equal length. Second, draw an equilateral triangle that has the middle segment from the first step as its base and points outward. Third, remove the line segment that is the base of the triangle from the second step. After one iteration, the resulting shape is the outline of a hexagram. A Koch snowflake is the limit approached as the above steps are followed over and over again. The Koch curve can be constructed with only one of the three sides of the original triangle. In other words, three Koch curves make a Koch snowflake.

Figure 7A:
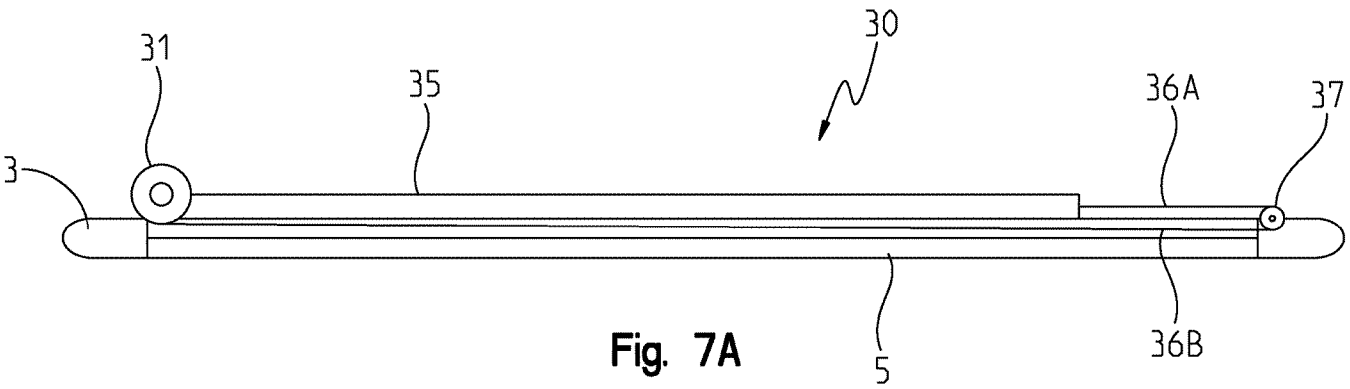
FIGS. 7A and 7B are another embodiment of an IS assembly that can include an EM wave energy absorptive cover.
Figure 7B:
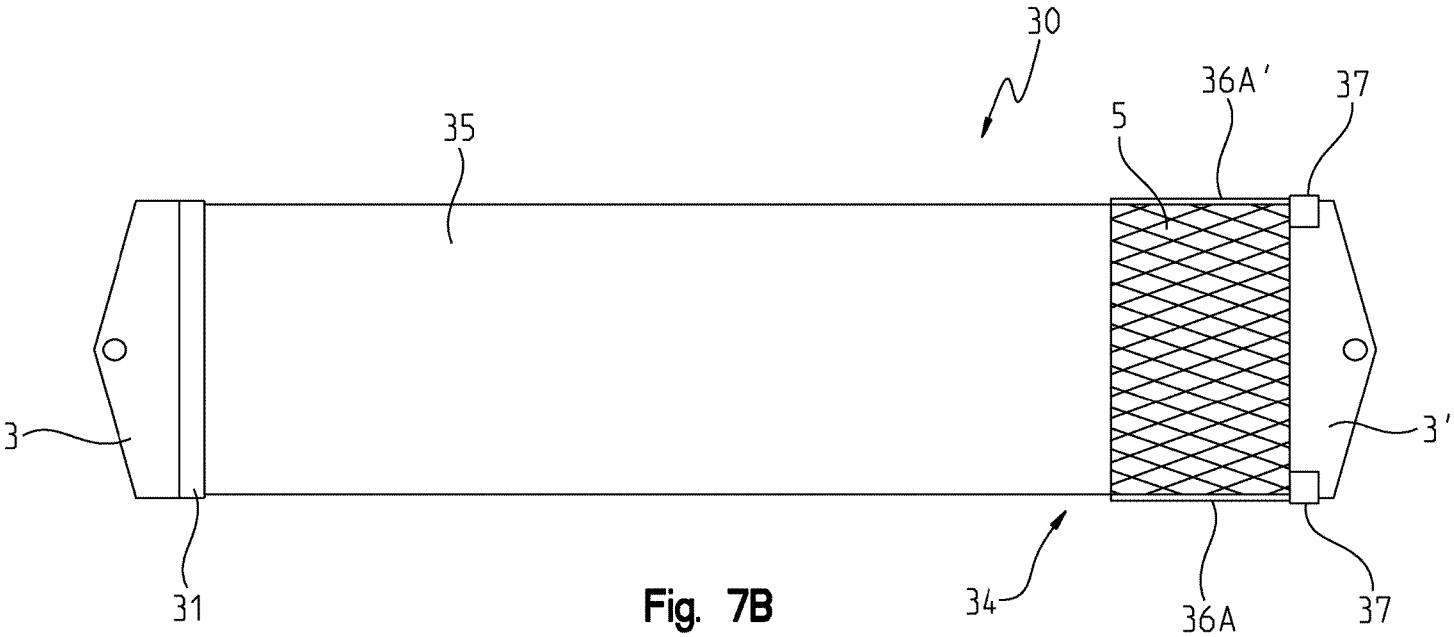

Referring to FIG. 7, another embodiment of an IS assembly or system 30 can include an EM wave energy absorptive cover 35 which can retractably cover an exemplary IS blanket 5 such as by using of a retraction/extension system (e.g., housing 31, wire 36A/36B, pulley 37), and actuators or motors or another motive system (not shown) which provides mechanical force to retract or extend the cover 35. This alternative IS assembly 30 embodiment can provide a feature that hides the IS blanket 5 so it does not provide influence impacts on its environment or to entities in a detection area until an operator so desires such an effect. An alternative embodiment can also include a housing 31 spring loads a retraction/extension system so as to retract the cover 35 when the cover is unlatched from a latching point (not shown) when the cover is in a deployed position covering the blanket. A latching system can be built into the housing 31 or located at a section of the blanket 5 which is on an opposing side of the IS system 30 such that the cover 35 is in a full extended position when latched and when the latch is released a spring loading system (not shown) built into the housing 31 retracts the cover 35 automatically. An exemplary cover 35 can be made of wave energy, e.g., radar, absorptive material. The cover can also be made of a material which presents a neutral infrared (IR) emission so that it does not radiate IR or other EM energy and can further be non-reflective in a visible light spectrum. A cover 35 design can include a cable 36A/36B which runs on the outside edge 34 of the blanket 5 which is secured on an end of the blanket 5 which is drawn from the housing 31. An embodiment of the cover 35 can be slideably coupled to the cable 36A/36B so that when the cover 35 is drawn across the blanket 5 the cover 35 is secured in position relative to the blanket 5. An embodiment of the cover 35 can have bottom edges which have a magnetic strip (not shown) which couples to ferromagnetic metal strips along an edge of the blanket (not shown) so that the cover 35 is attracted to the edge of the blanket 5 so that when the cover 35 is deployed or retracted its edges remain in sliding contact with the metal strips. This exemplary embodiment of the IS system 30 can also have a tow yoke 3, 3'.

Figure 8A:
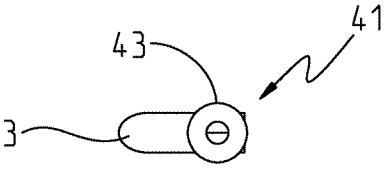
FIGS. 8A, 8B, and 8C shows an alternative embodiment of an IS assembly including a retractable and extendable blanket which has an extension/retraction system.
Figure 8B:
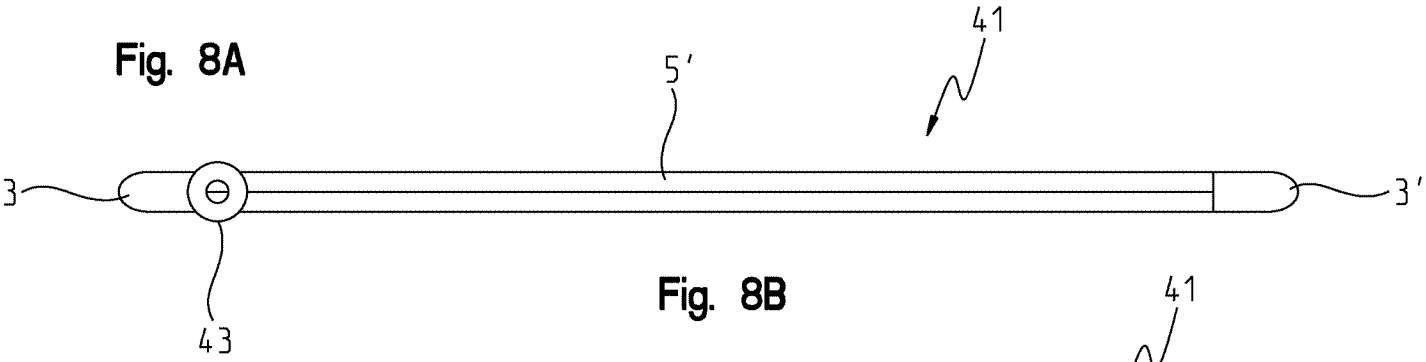
Figure 8C:
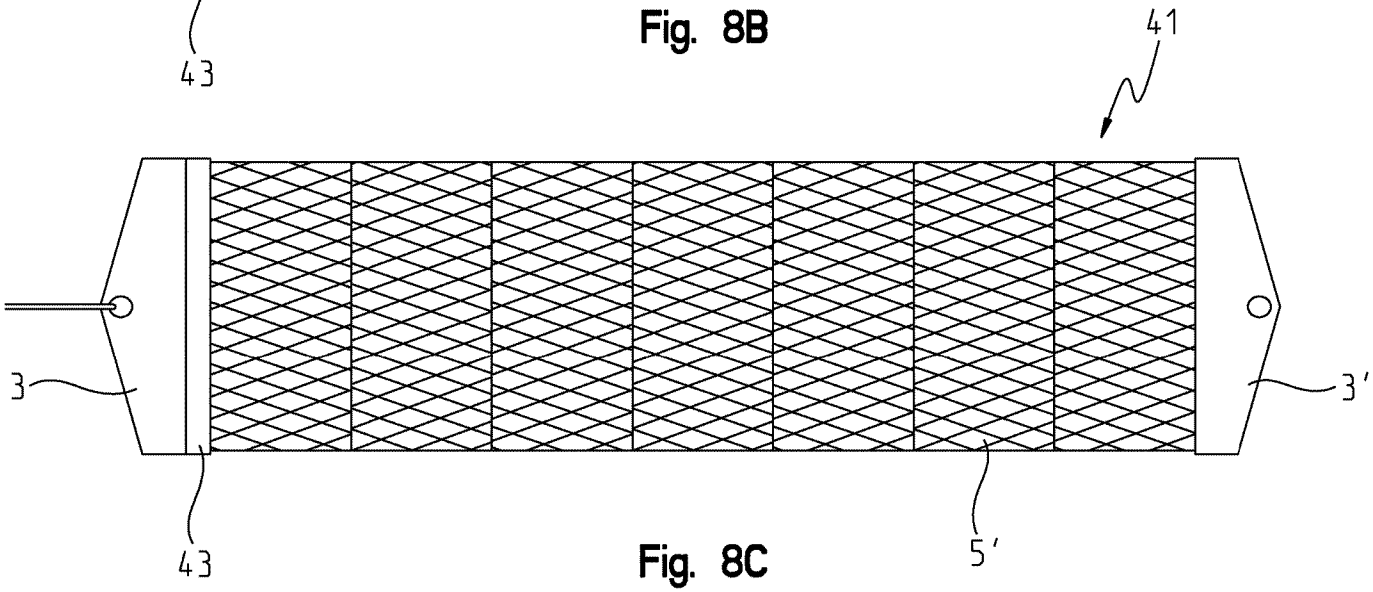

Referring to FIGS. 8A, 8B, and 8C, an alternative embodiment of an IS assembly 41 can include a tow yoke 3 coupled to a housing 43 which contains a rolled-up blanket 5' which has an extension/retraction system e.g., electric motor, spring loading for extension after a latch is released, a drag chute which is released into the water (not shown) that permits the rolled-up blanket 5' to extend when a control or locking mechanism (not shown) releases the rolled-up blanket 5' so it is free to rotate and allow the blanket 5' to unroll into an extended position (see FIGS. 8B and 8C). A control mechanism (not shown) can engage or disengage the control or locking mechanism (not shown) when a control signal is received by the control or locking mechanism. Other extension systems could include a pyrotechnic device (not shown) to rapidly extend the blanket 5' which is mounted, e.g., on the housing 43. The housing 43 can be towed by a vessel or structure and can be adapted to ensure that a tow yoke 3 section of the blanket 5' is oriented away from the towing vessel or structure so as to rapidly extend the blanket. In other words, an IS system 41 including an IS blanket 5' comprising an antenna assembly comprising a flexible elongated sheet fractal radiating element (blanket) which is movable between a retracted (rolled) position and an extended position (unrolled), and an extension mechanism which is adapted to extend the radiating element upon a command. The extension mechanism (not shown) can alternatively be automatically activated upon detection of a signal of interest by a sensor (not shown) attached to the IS system 41 or by command provided from a control unit (not shown) which is coupled to an input/output (I/O) element of the IS system 41. A second tow yoke 3' can be attached to an opposing end of the blanket 5' from the first tow yoke 3 to permit daisy chaining or attachment of the IS system 41 to another object such as another vessel including an unmanned or remotely controlled vessel (not shown).

Figure 9:
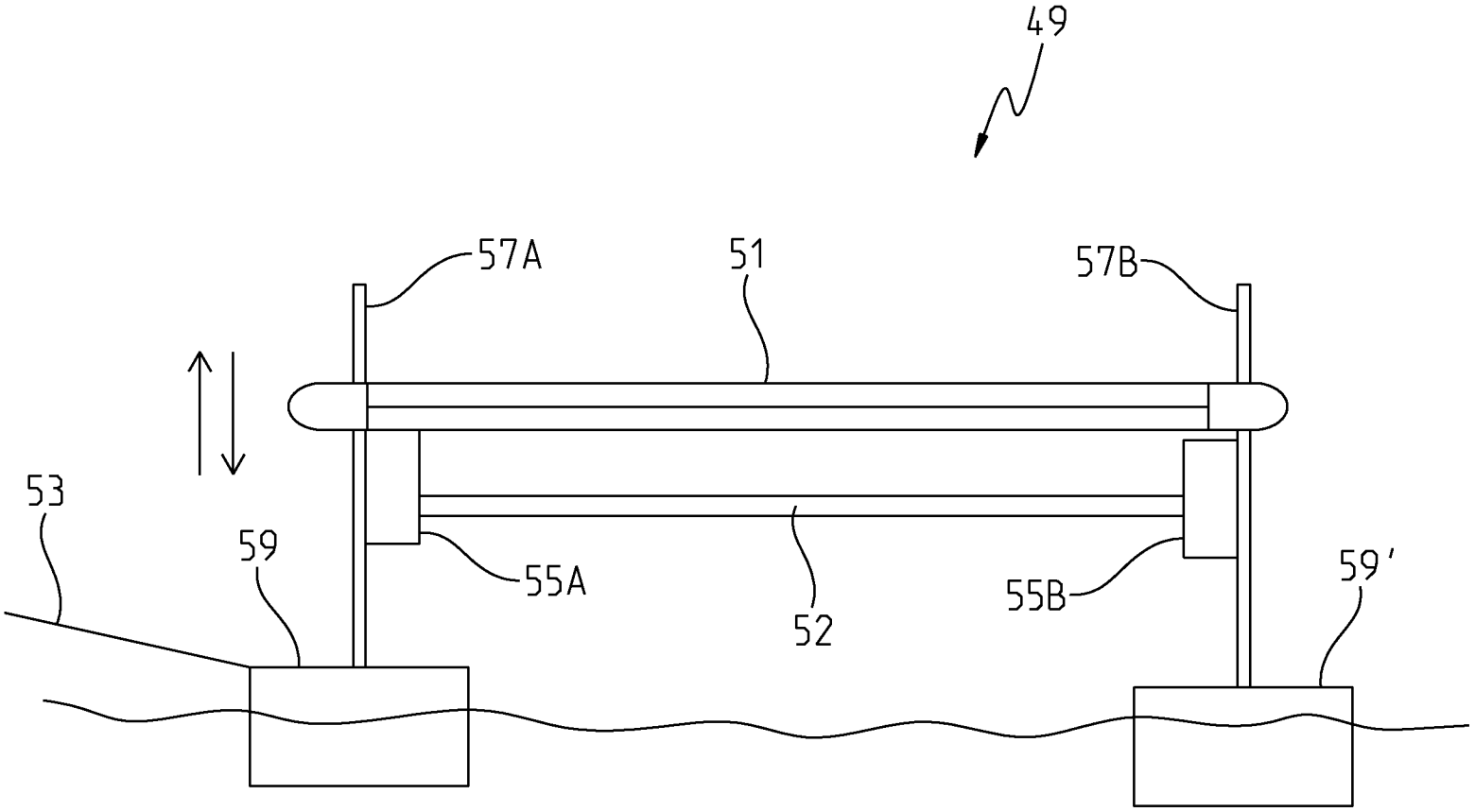
FIG. 9 shows an IS system including a support section adapted to move a blanket relative to a surface.

Referring to FIG. 9, a support section having pylons 57A, 57B and motor systems 59, 59' which are coupled to an IS blanket embodiment (e.g., blanket 5) such that the motors traverse the pylons which elevates or moves blanket 51 relative to a surface e.g., sea. The pylons 57A, 57B, are coupled to flotation sections 59, 59' which can be further controlled to have a variable ballast e.g., with water so as to further raise or lower the pylons so the blanket 51 is further maintained at a desired height with regard to a plane defined by the surface that the IS system is resting upon e.g., sea. A second set of pylons (not shown) with corresponding flotation sections and motor systems (not shown) can be added to provide pylons connected to each of the corners of the blanket 51 such that the blanket's 51 angle with respect to the surface can be altered as well as having the blanket's 51 height adjusted. A tow rope 53 can be attached to the exemplary IS system 49 at, e.g., one of the flotation sections 59. A lateral structure 52 can be attached between motor systems 59, 59' to provide additional structural strength and to ensure lateral separation of the pylons 57A, 57B. Additional lateral structures can be coupled between additional motor systems or between tow yokes coupled on either end of the blanket 51 to provide separation and extension functions for the blanket 51. An alternative embodiment of the lateral structures e.g., 51 can be designed to be telescoping to permit retraction of the blanket by means of an extension/retraction system (not shown).

Figure 10:
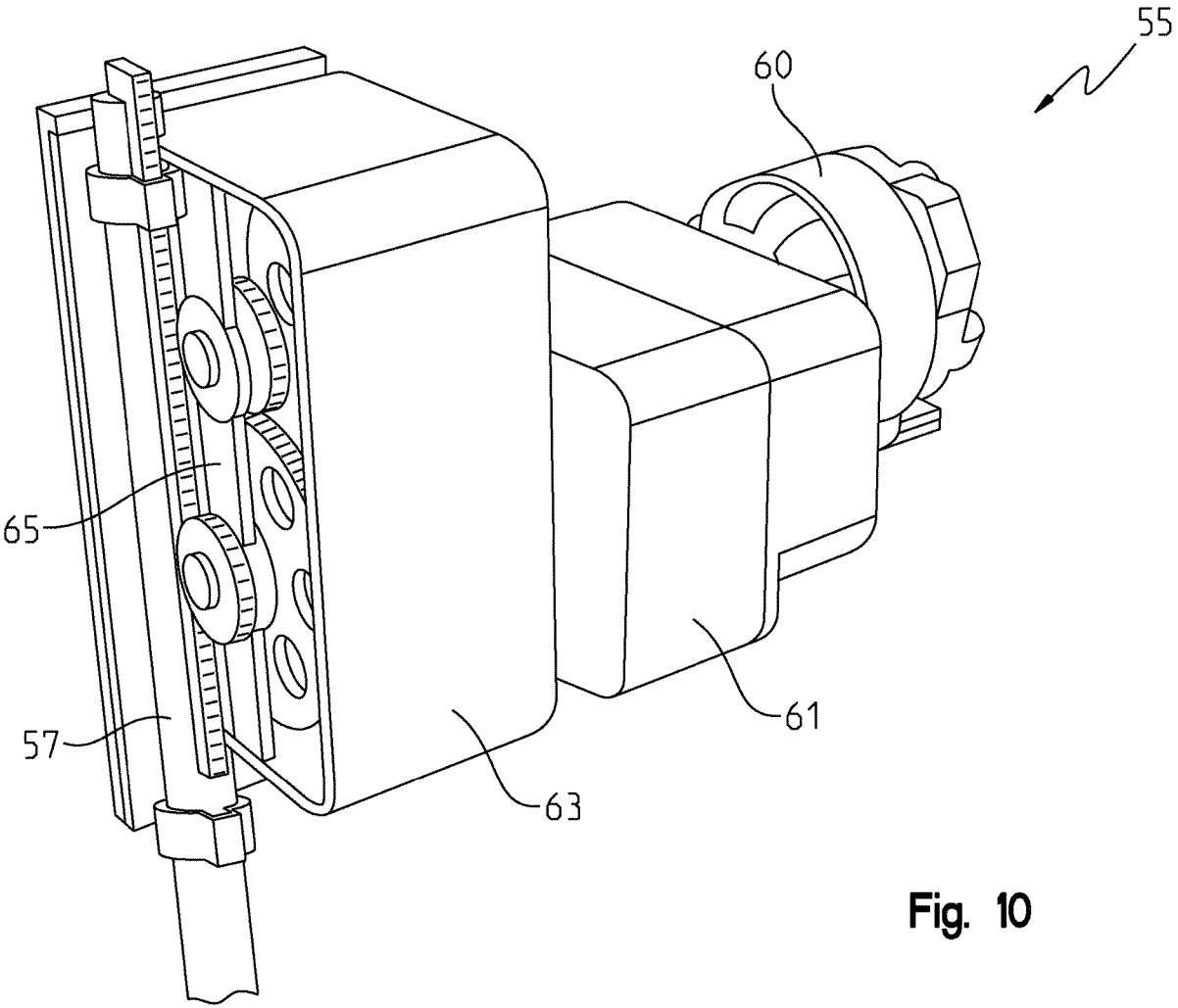
FIG. 10 shows an exemplary motor system for moving an IS blanket relative to a surface.

Referring to FIG. 10, an exemplary motor system 55 (e.g., 55A, 55B from FIG. 9), is shown including an electric motor 60, a unidirectional gear 61, speed increasing gears 63, and a rack and pinion system 65 which couples to a support pylon 57. The motor system can also be adapted to function as a generator which generates electricity as the IS system moves up and down due to wave action so that the pylons are driven up and down through the motor systems in order to generate electricity in a standby mode.

Figure 11:
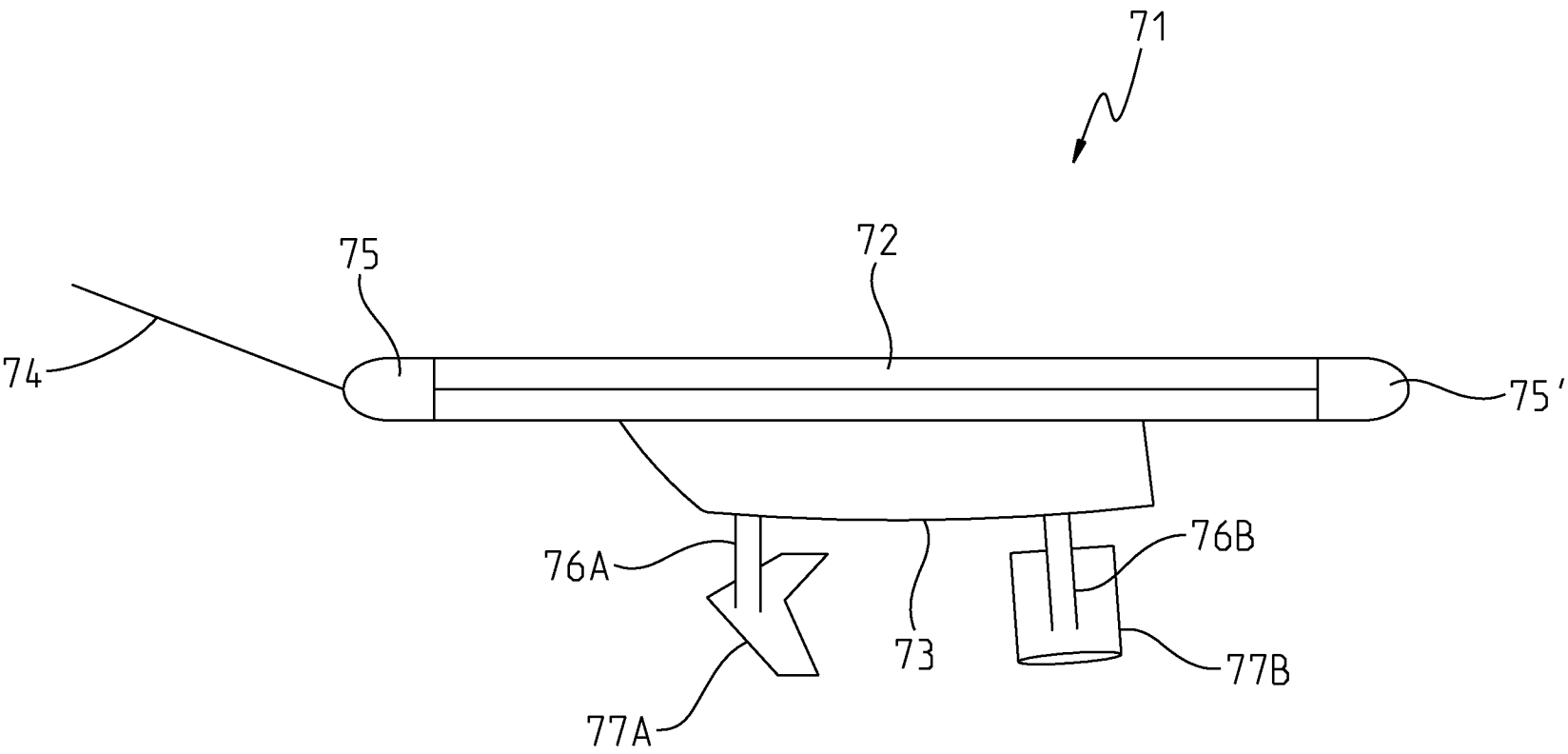
FIG. 11 shows a support structure and a structure adapted to elevate an IS blanket above a surface such as a body of water using a hydrofoil.
Figure 12B:
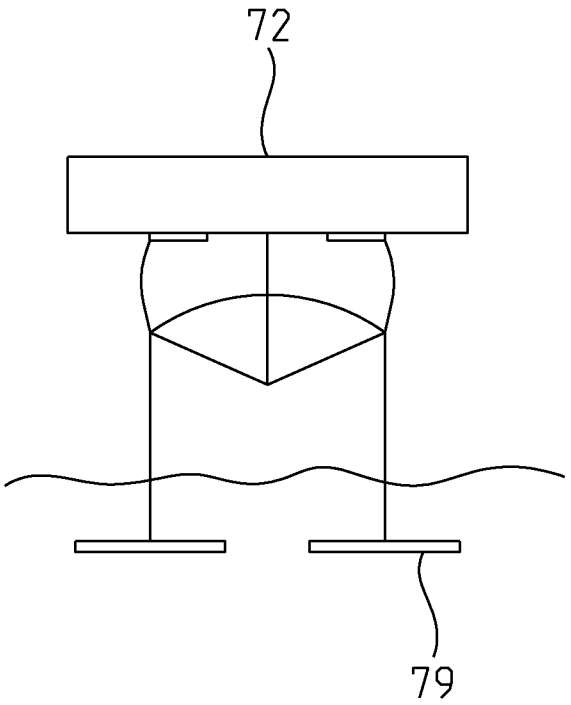
FIGS. 12A and 12B show a front view of the FIG. 11 IS assembly on two different hydrofoil systems including a surface piercing and a fully submerged version.
Figure 12A:
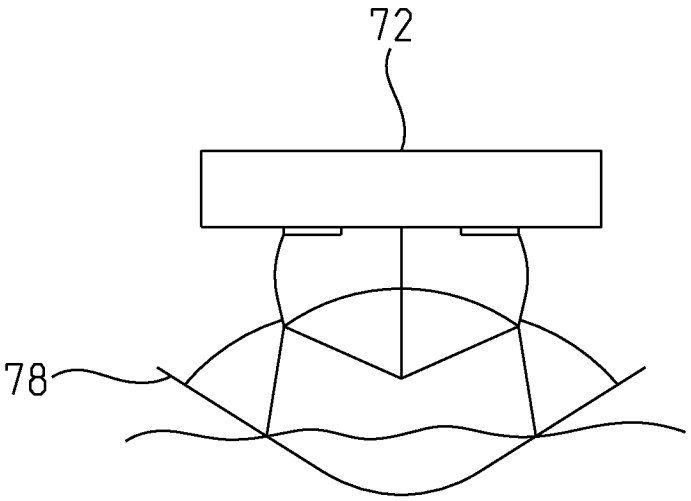

Referring to FIG. 11, another alternative embodiment of an IS assembly 71 which includes an IS blanket 72 (e.g., FIG. 1, 5), with a forward tow yoke 75 on one end and a rear tow yoke 75' on an opposite end of the IS blanket 72. A tow cable 74 is attached to the forward tow yoke 75. The IS blanket 72 is coupled to a support structure 73 (e.g., a floating structure). A forward hydrofoil assembly including a strut 76A and a hydrofoil 77A is attached to a lower section of the strut 76A which is in turn attached to a forward section of the support structure 73. A rear hydrofoil assembly including a strut 76B and a hydrofoil 77B is attached to a lower section of the strut 76B is provided which is in turn attached to a rear bottom section of the support structure 73. The rear and forward hydrofoil assemblies are adapted to provide either a surface piercing or a fully submerged foil configuration which are designed to lift the support structure 73 into the air such that it is free of the ocean's surface when the IS assembly 71 is towed by a towing vessel or system. The hydrofoil structures further include an apparatus or system to vary the effective angle of attack of the foils to change a lifting force generated by the foils in response to changing conditions of ship speed, weight and sea conditions. One operational capability of hydrofoils with fully-submerged foils is the ability to uncouple the ship to a substantial degree from the effect of waves. This permits a relatively small hydrofoil ship to operate foilborne at high speed in sea conditions normally encountered while maintaining a comfortable motion environment for IS system 71 and permitting effective employment of on board equipment to include providing a stable platform for orienting the IS blanket 72. FIG. 12A and FIG. 12B show a front view of the IS assembly on two different hydrofoil systems including a surface piercing 78 and a fully submerged version 79.

Figure 13:
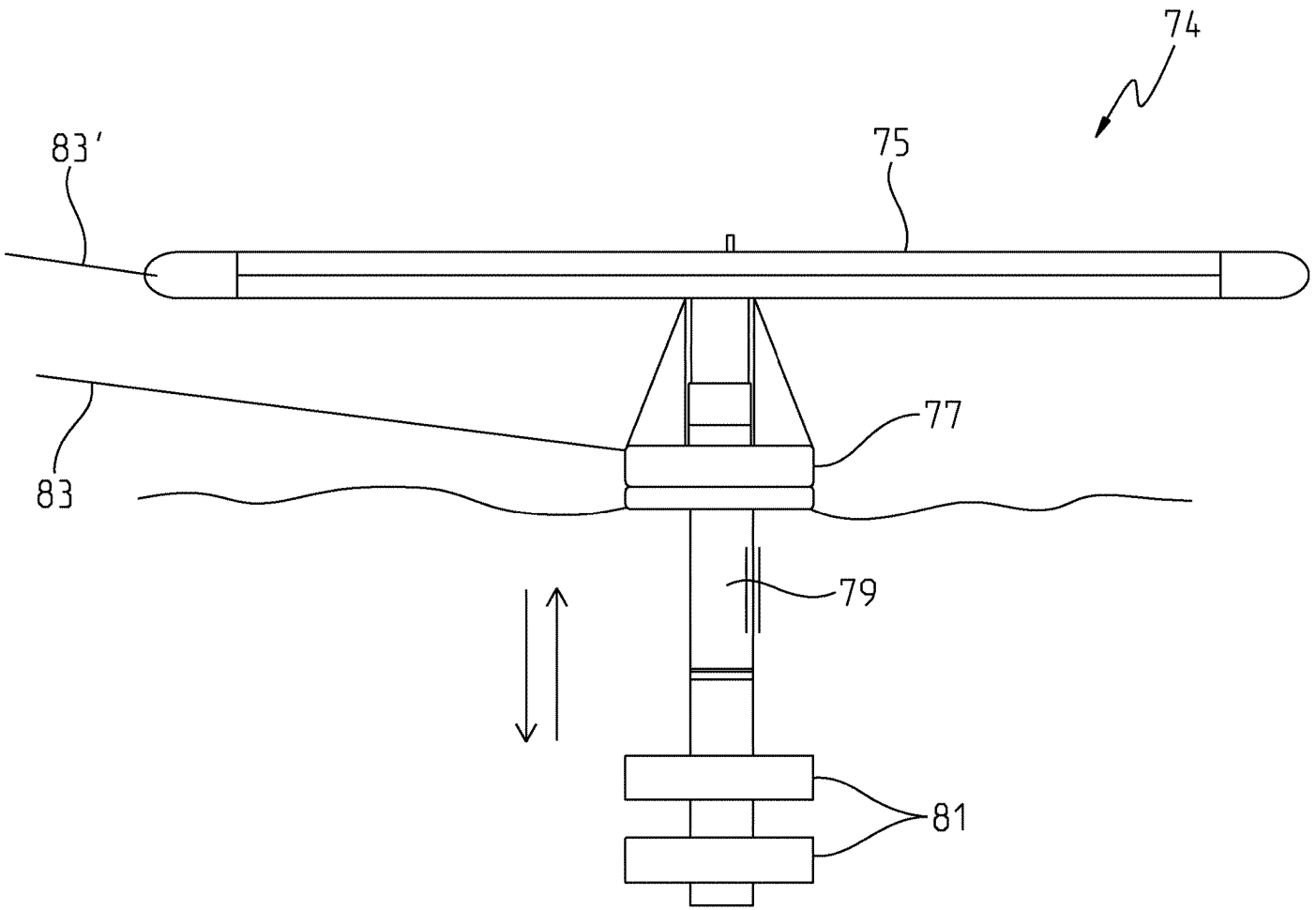
FIG. 13 shows an exemplary IS system which includes a support structure and a structure adapted to elevate an IS blanket above a surface such as a body of water using a buoy and a central column mount.

Referring to FIG. 13, an IS system 74 is shown including a lightweight IS blanket 75 (e.g., FIG. 1, 5), which is coupled to a towable buoy system which has a central column 79 attached to a center section of the IS blanket 75 structure. The buoy system has a cylindrical surface flotation chamber 77 which is adapted to permit the central column 79 to pass up and down within an aperture (not shown) within the flotation chamber 77. Several adjustable buoyancy chambers 81 are attached to the bottom of the central column 79 so as to provide a means for adjusting the height of the IS blanket 75 with respect to the surface flotation chamber 77. A first tow cable 83 is attached to the surface flotation chamber 77 and a second tow cable 83' is attached to a tow yoke coupled on one side of the IS blanket 75 to provide stability to the IS system 74 as it is towed. The shape of the surface flotation chamber 77, central column 79, and adjustable buoyancy chambers can be adapted to reduce draft as the IS system 74 is towed through water.

Figure 14:
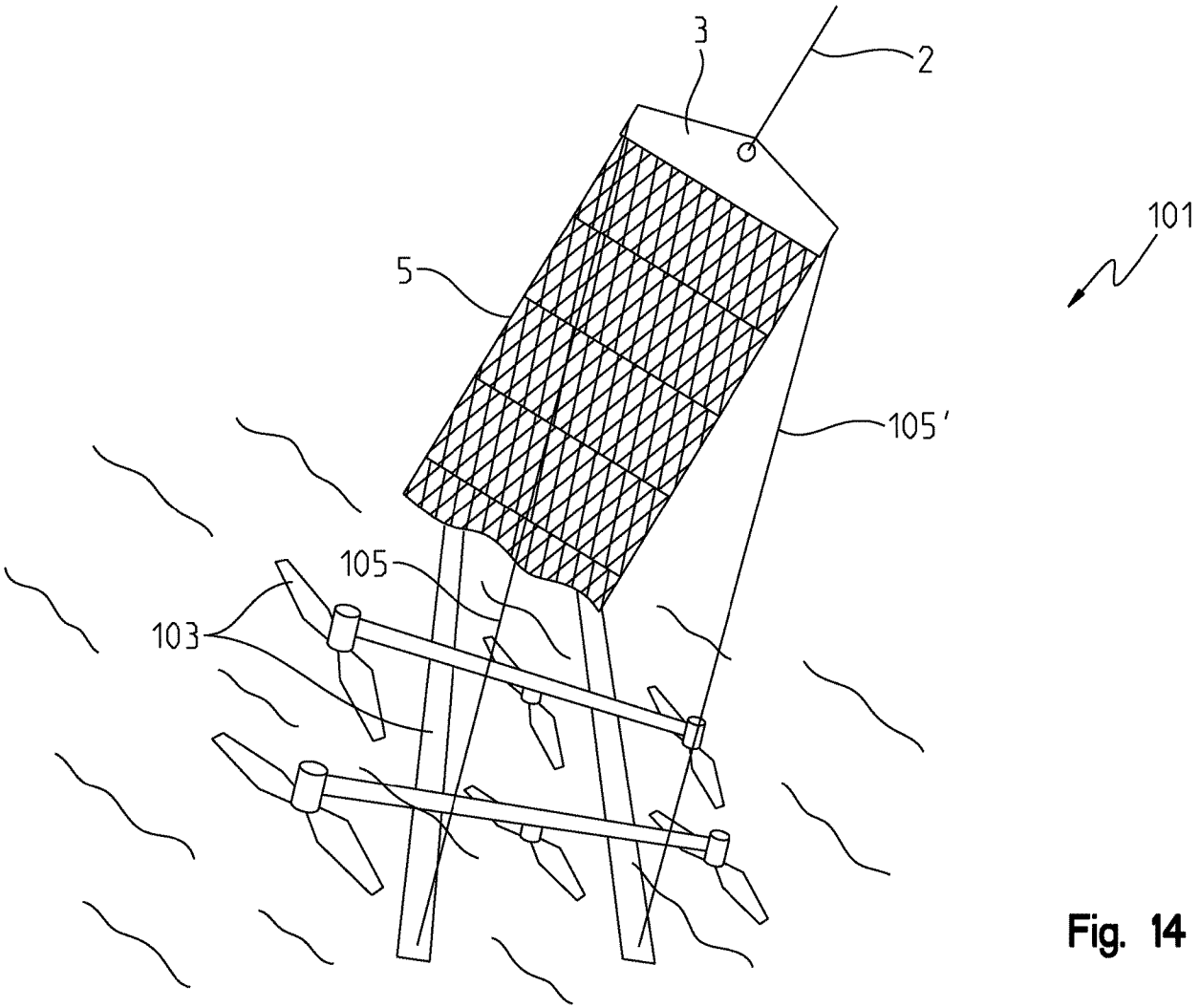
FIG. 14 shows an exemplary IS system having a steering structure adapted to steer an IS system relative to a defined position.

Referring to FIG. 14, an IS assembly 101 is provided with a steering section 103 which is immersed in water having several vertical lateral sections attached to a rear section of an support structure (not shown) coupled and supporting an IS blanket 5 which can maneuver the IS assembly 101 while it is towed behind a vessel. The vertical sections are coupled by one or more lateral sections which are attached at 90 degrees to the vertical sections at one or more spaced apart sections of the vertical sections. The IS blanket 5 has a tow yoke 3 attached on an end opposing an end where the steering section is attached to the IS blanket 5. The tow yoke 3 is coupled to a tow cable 2. The tow yoke 3 is also attached to the steering section 103 by support cables 105 and 105' which are attached on opposing sides of the tow yoke 3 on one end and opposing sides of a lower section of the steering structure 103 on an opposing end of the support cables 105' and 105. The steering section 103 can include rudder systems, underwater structures tethered to the support structure or blanket structure 5 such as fabric or other structure to selectively introduce drag or minimize drag and thereby cause force to be selectively applied to different sides of the support structure or blanket 5 to effect movement. The vertical section(s) can also be used to act as a rudder to maneuver the support structure or blanket 5 either in the air or in the water. The steering section can also have electric generators and/or propellers attached to lateral section and/or vertical framework associated with the steering system 103 which has propellers attached to the generators so that when the IS system 101 is towed through the water so that electricity is generated for systems on board the exemplary IS system 101.

Figure 15:
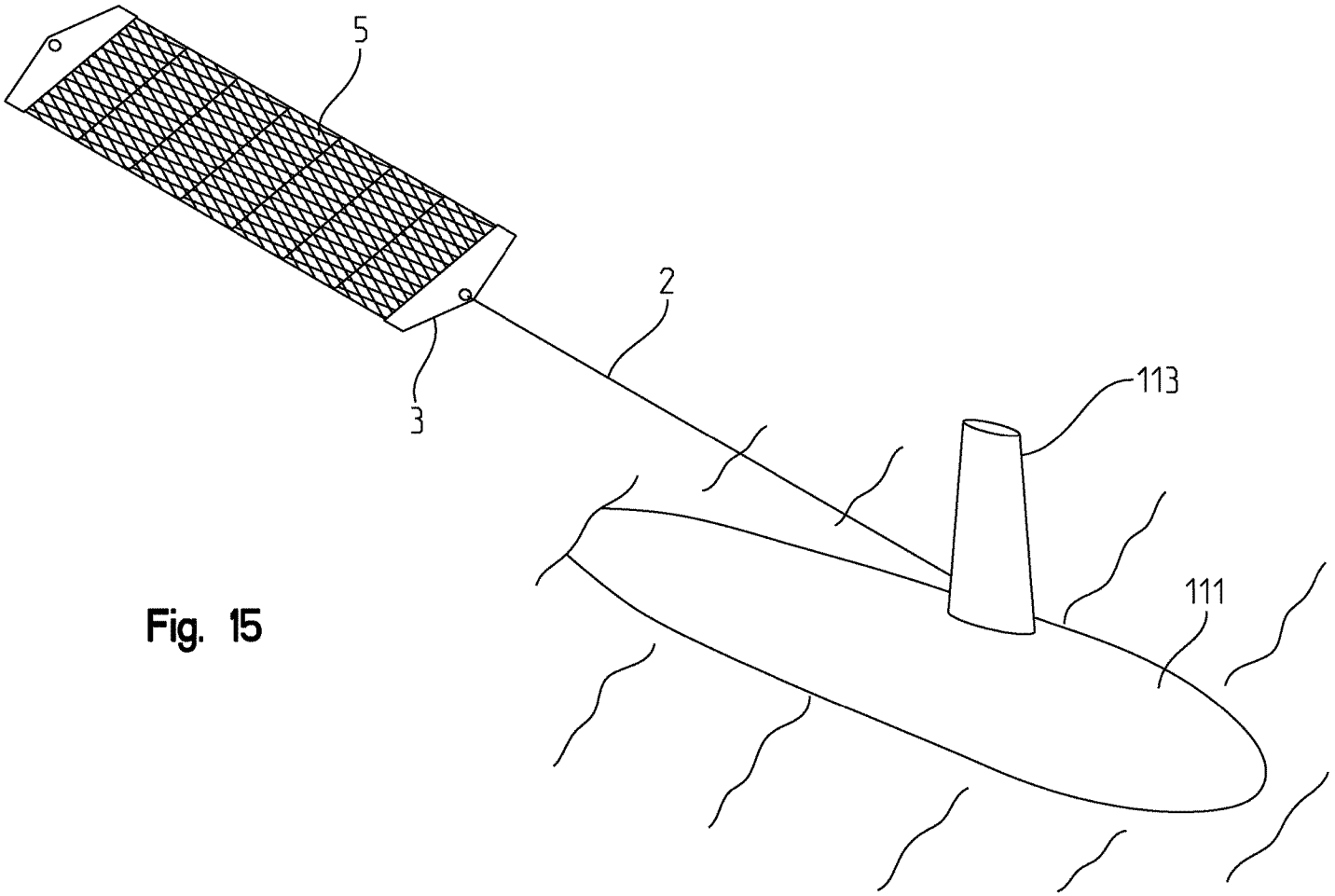
FIG. 15 shows an IS system including a submersible adapted to tow an IS blanket.

Referring to FIG. 15, either a towed or powered submersible 111 can have a mast section 113 which includes a deployable blanket 5 as described above which can be deployed using, for example, an extendable/retractable housing (not shown but see FIGS. 8A, 8B, and 8C) or alternatively an airbag type deployment system or a deployable parasail type structure which elevates the blanket above the towed or powered submersible or on an ocean or water surface (such as in FIG. 1) which provides a desired IS effect. A tow yoke 3 is attached to the IS blanket 5 which is in turn coupled to a tow cable 2 which is in turn coupled to the submersible 111 or mast 113.

Figure 16:
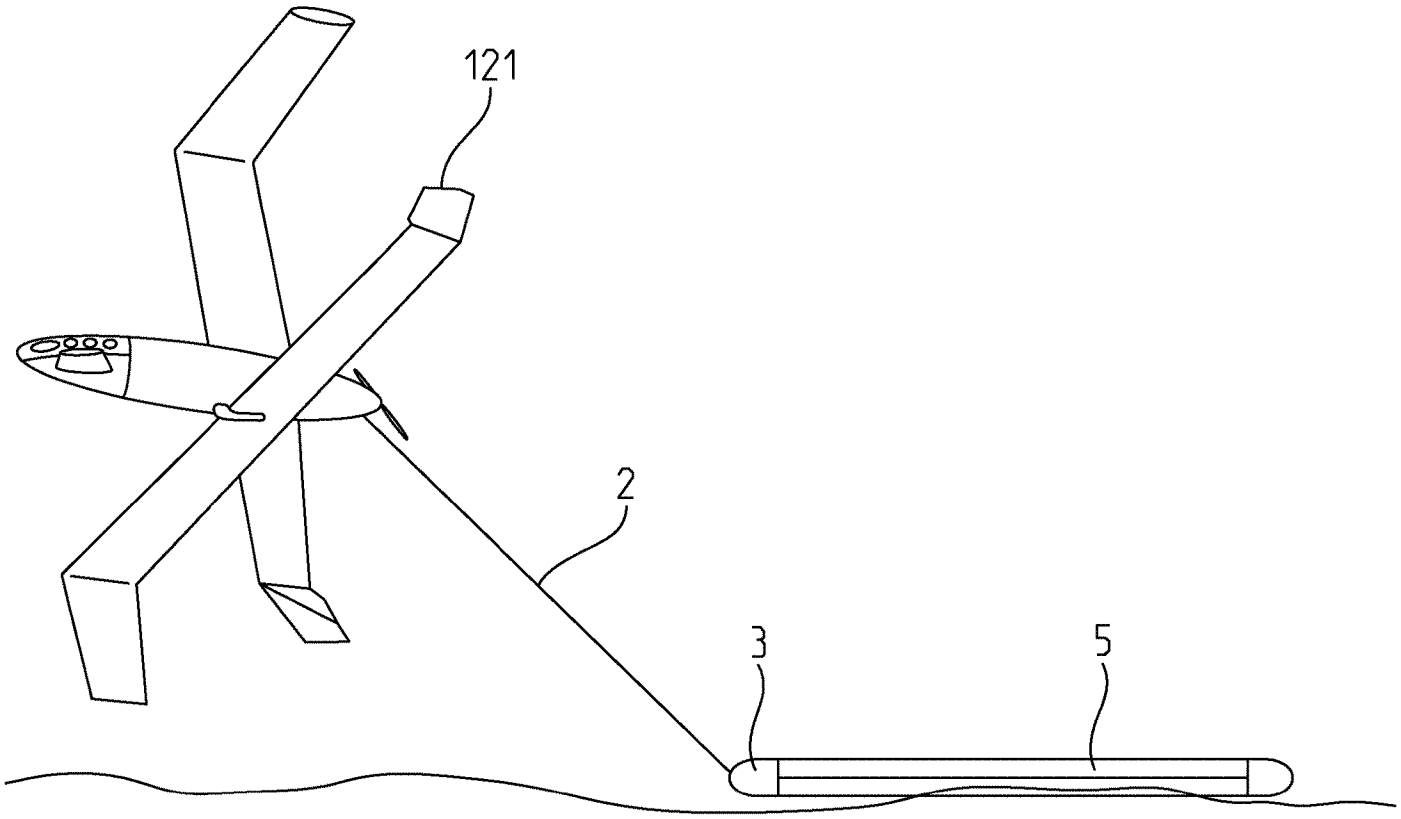
FIG. 16 shows an ejectable foldable unmanned aerial vehicle adapted to tow an IS system as described herein.

Referring to FIG. 16, another embodiment can include an ejectable foldable unmanned aerial vehicle (UAV) system 121 adapted to be ejected from a tube mast on a vessel (not shown herein however e.g., see FIG. 14 mast on the submersible 111) or a towed system (not shown) which can deploy an embodiment of a towed IS blanket (e.g., FIG. 1, 5) such as described herein. The ejectable foldable UAV system 1121 can have a power tether which provides power to the UAV system from a vessel (not shown) as well as providing an ability to tow the UAV to ensure sustained lift which in turn tows an embodiment of the towed IS blanket via a tow yoke 3 attached to the IS blanket via tow cable 2. The towed IS blanket 5 can be furled or rolled so that it deploys when the UAV ejects or it can have the blanket 5 unfurl or unroll from a housing (not shown) that is either towed by the UAV 121 or attached to the UAV 121 e.g., bottom or top or within the UAV 121.

Figure 17:
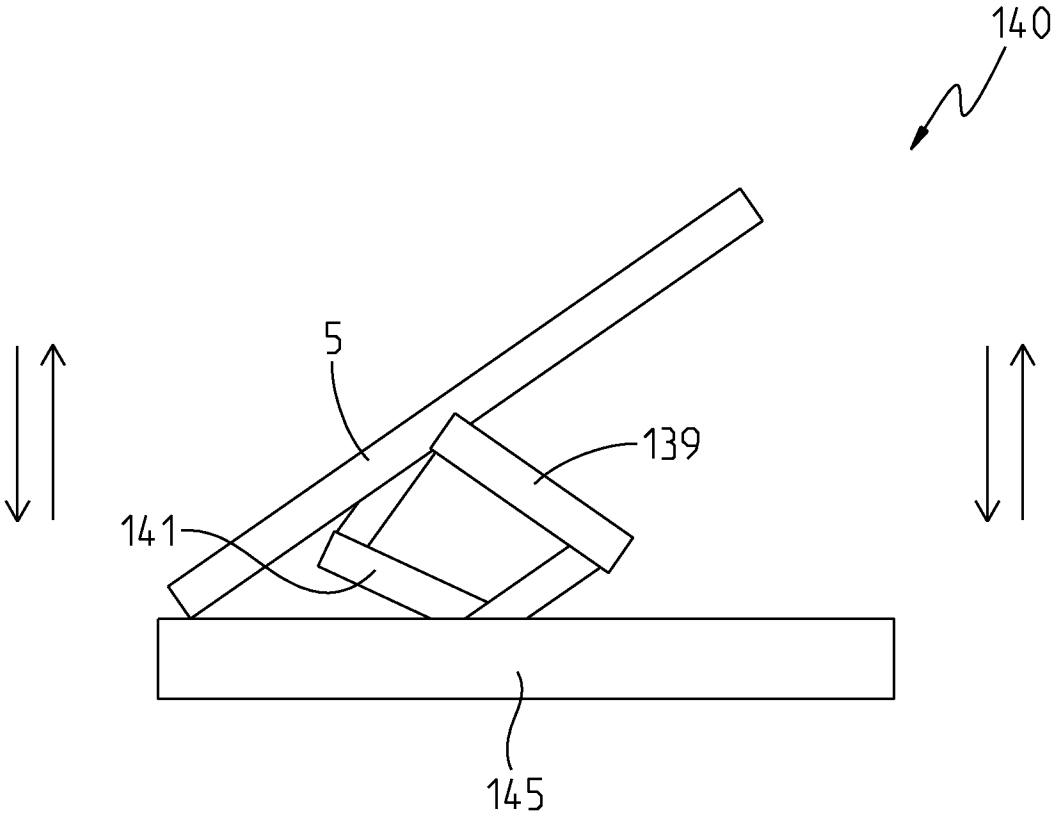
FIG. 17 shows another embodiment of a reorientable IS system which includes a structure adapted to tilt or pivot sections of an IS blanket.

Referring to FIG. 17, a longitudinal view of a repositionable and reorientatable IS blanket system 140 which includes an IS blanket 5 (e.g., such as described herein) is shown which can be pivoted or angled laterally from a longitudinal axis so that a face of the IS blanket 5 can be rotated by spring loaded tilt/pivoting hinges 139, 141 along an axis substantially at a center section of each end of the IS blanket structure 5. The tilt hinges include a first spring loaded lateral tilt hinge member 139 coupled to one end of the IS blanket 5 and a second spring loaded lateral tilt hinge 141 coupled on an opposing end of the IS blanket 5. The hinges are also coupled to a support section 145 which comprises flotation sections and a rigid support frame. Either end of the IS blanket 5 can be raised, tilted, etc to rotate or reposition the IS blanket 5 along the axis substantially at a center section of each end of the IS blanket 5 as well as raising either end independently to tilt the blanket along a second axis so as to enable directional control of wave energy which is being resonated or reflected from the IS blanket 5 A bar (not shown) can be coupled between the spring loaded tilt pivoting hinges (not shown) to provide additional stability and coordination of movement. Actuators (not shown) can be attached to both sides of the IS blanket 5 in order to provide mechanical force to rotate the IS blanket 5 around the axis substantially at the center section of each end of the IS blanket 5. This repositionable and reorientatable IS system 140 can be towed or maneuvered in a variety ways, such as those discussed herein.

Figure 18B:
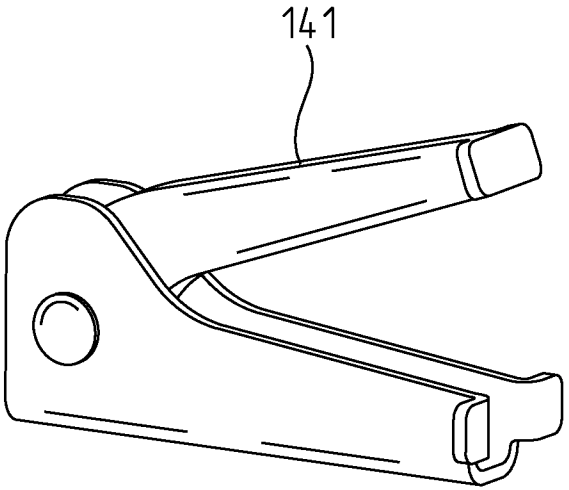
FIGS. 18A and 18B show one example of a FIG. 17 structure adapted to tilt or pivot sections of the IS blanket.
Figure 18A:
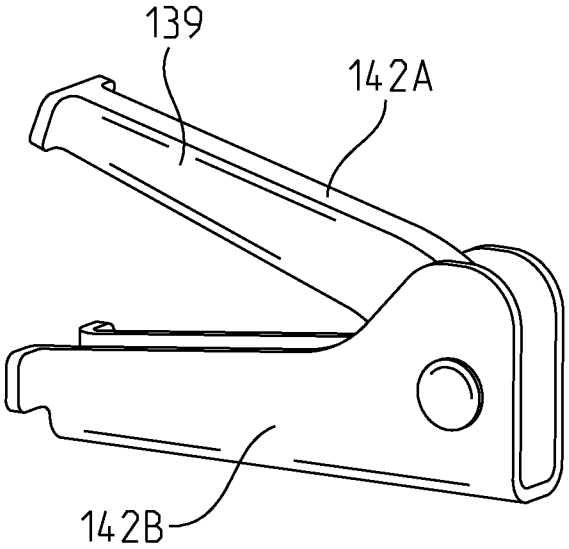

FIGS. 18A and 18B show a closer view of the spring loaded lateral tilt hinges 139, 141. A first section 142A is coupled on one end to a second section 142B where the second section 142B is formed with a cavity similar to a folding pocket knife which is adapted to permit the first section 142A to rotate into the cavity within the second section 142B. Another portion of the second section of each hinge 139, 141, is rotatably attached to the support section (145) while another portion of the first section of each hinge is rotatably attached to the IS support blanket of FIG. 17.

Figure 19A:
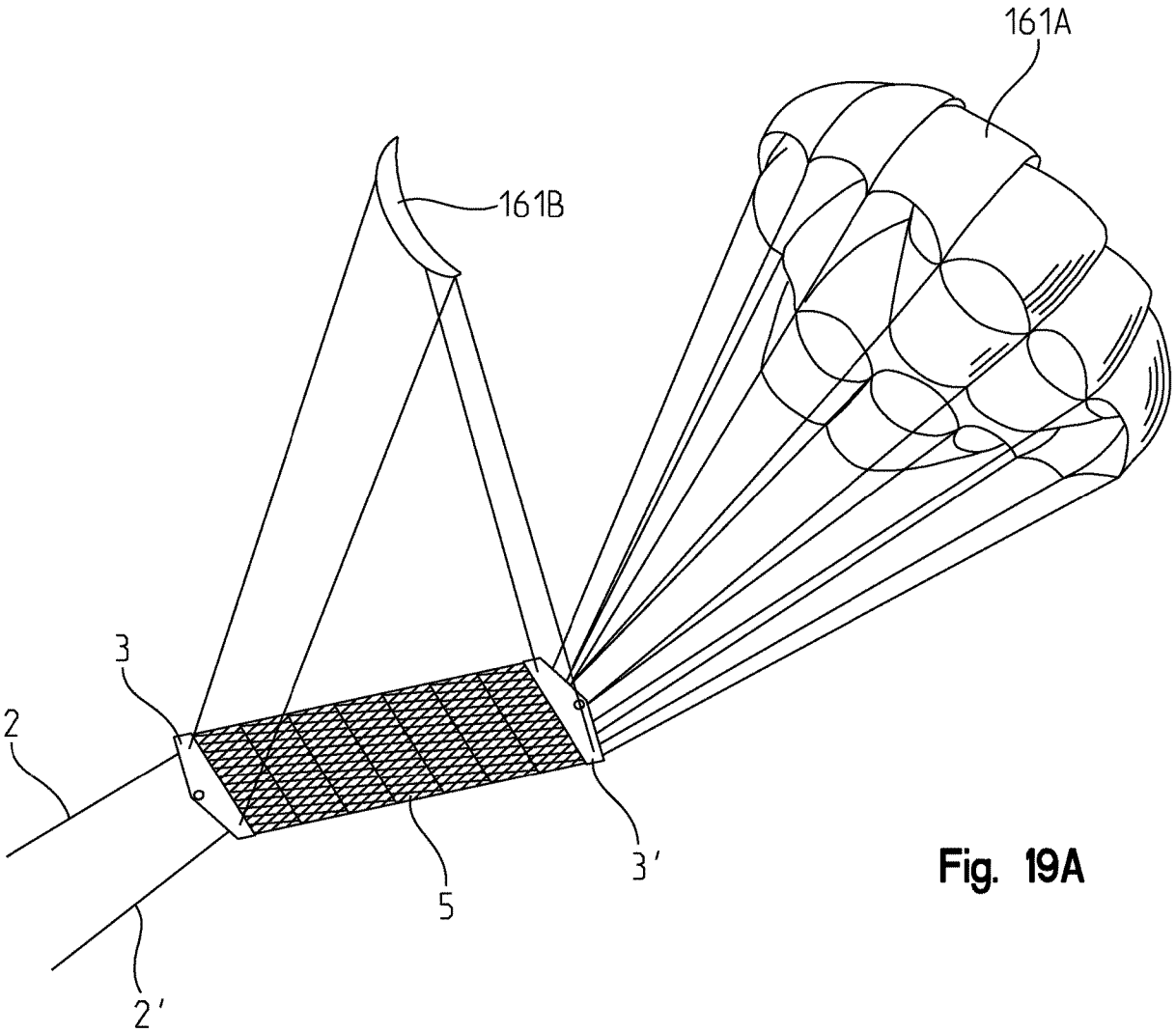
FIGS. 19A and 19B show a deployable parasail or parachute that can also be coupled to an exemplary IS blanket to cause the IS blanket to rise into the air to a desired height as it is towed.
Figure 19B:
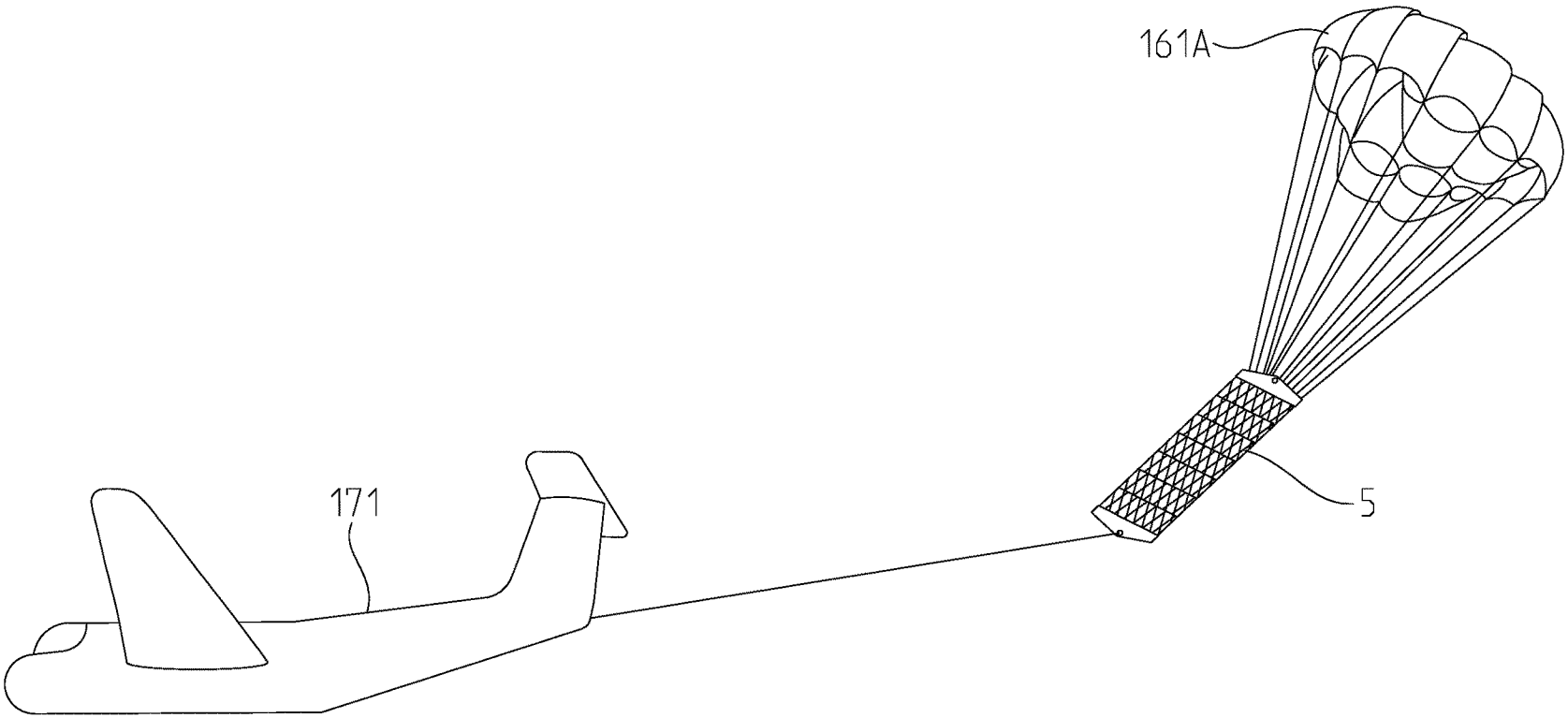

FIGS. 19A and 19B show a deployable parasail or parachute 161A that can also be coupled to an exemplary IS blanket 5 to cause the IS blanket 5 to rise into the air to a desired height as it is towed. The parasail 161A can also be coupled to a portion of the IS blanket 5 which is adapted to decouple from the support structure or a portion of the blanket to rise into the air while leaving a base section knot shown) on the ocean surface. This base section can be steerable as it is towed behind a towing vessel (not shown, but see, e.g., FIG. 2). A second lifting structure 161B can be coupled to other sections of the IS blanket 5 (e.g., a side opposing a side which the parasail or parachute 161A is attached) in order to provide sufficient lift to position the IS blanket 5 substantially laterally to a plane defined by a terrestrial surface such as a sea surface. Two tow cables 2, 2' can be attached to a tow yoke 3 attached to an end of the IS blanket 5 on either side of one end of the IS blanket 5 in order to provide a desired orientation of the IS blanket e.g., substantially parallel with regard to the plane defined by a terrestrial surface however the two tow cables 2, 2' can be selectively manipulated by a towing apparatus in order to turn or re-orient the IS blanket e.g., twist the two cables 2, 2' in order to rotate the IS blanket with regard to an axis defined by a line through a longitudinal aspect of the IS blanket 5. For example, see FIG. 19B showing a simplified IS system with an aircraft 171 towing IS blanket 5 with simplified a parasail representation from FIG. 19A's parasail 161A without 161B. A tow yoke 3 can be attached to one end of the IS blanket 5 in order to provide an attachment point for the tow cables and another tow yoke 3' can be attached on an opposing end to the first tow yoke 3 to provide an attachment point for the parasail or parachute 161A.

Figure 20:
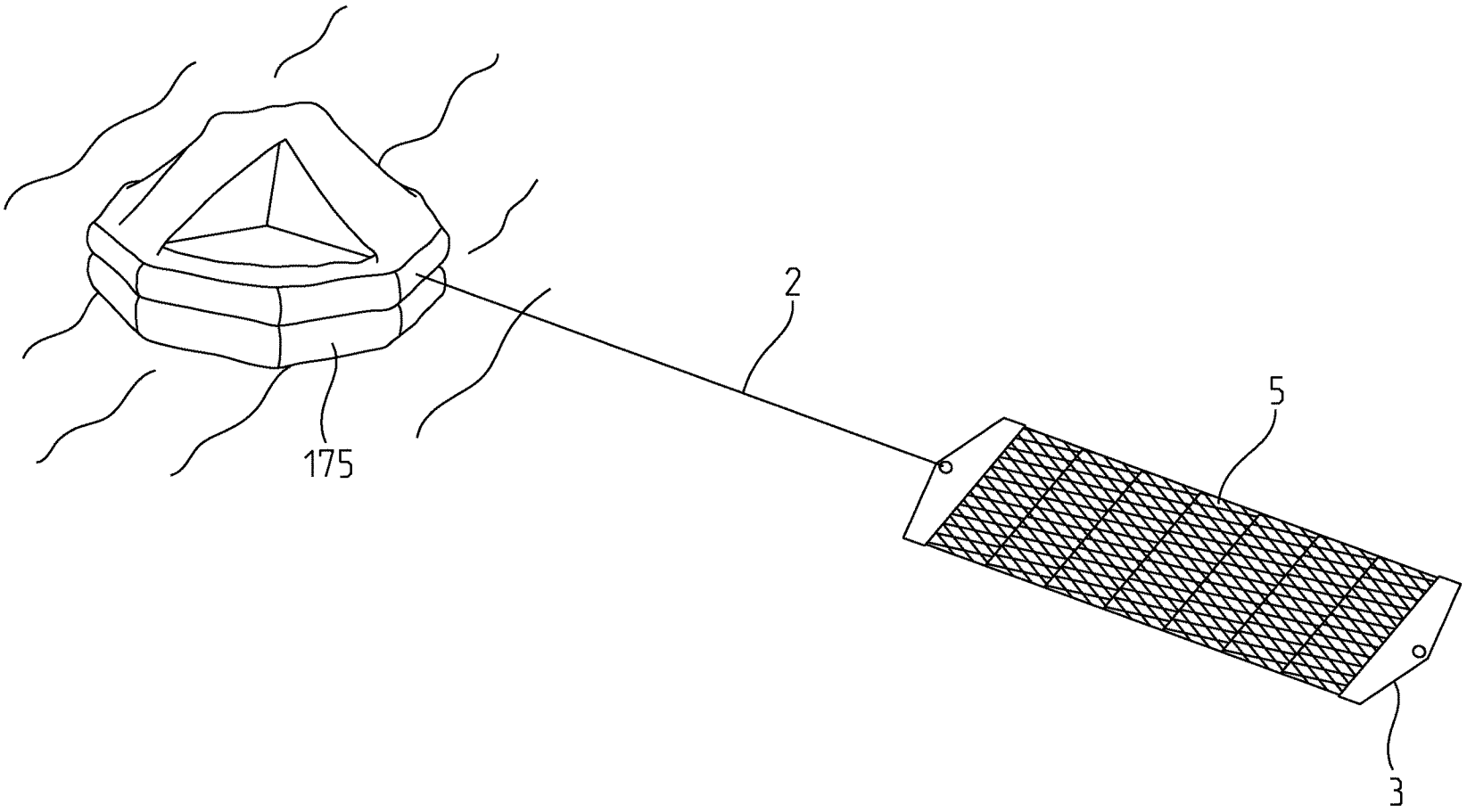
FIG. 20 shows an embodiment of the invention adapted to be coupled to a another structure such as a life raft ejected from a moving structure such as an aircraft.

Referring to FIG. 20, an embodiment of the invention can also be adapted to be coupled to life rafts 175, ejected from a rescue aircraft 171 or attached to aircraft, vessels, or space craft (not shown) to be deployed in distress situations where an aircraft has crashed or a vessel is sinking, or in distress or such a raft is desired to be deployed. A parachute 176 can be used to deploy the life raft. An IS blanket such as shown in FIG. 1 or elsewhere herein (not shown) is adapted to be deployed from the life raft 175 either upon being dropped or after the life raft has been deployed. In one embodiment, the parachute is formed with IS blankets such that it floats and continues to be coupled to the life raft 175. An alternative embodiment (not shown) can also be packaged into an air deployable structure which is dropped from a rescue aircraft and has an airfoil or parasail which is capable of being remote controlled and further including a base structure comprising a support structure and a blanket structure as described above where the base structure is steerable and can be maneuvered similar to sailboats, sail, or parasail powered vessels. FIG. 20 shows an embodiment of the FIG. 19 embodiment having a life raft 175, a tow cable, 2, a tow yoke 3 coupled to the tow cable 2, an IS blanket such as discussed herein attached to the tow yoke 3, and another tow yoke attached to another section of the IS blanket 5.

Figure 21A:
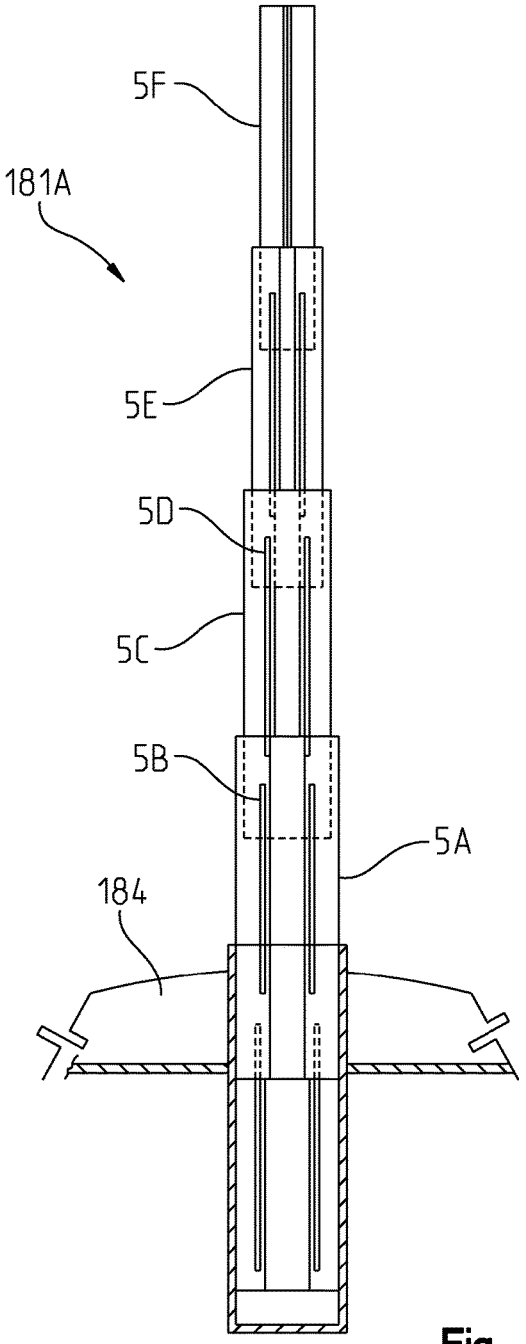
FIGS. 21A and 21B show a telescoping structure formed with fractal sections in accordance with one embodiment of the invention in an extended and retracted mode.
Figure 21B:
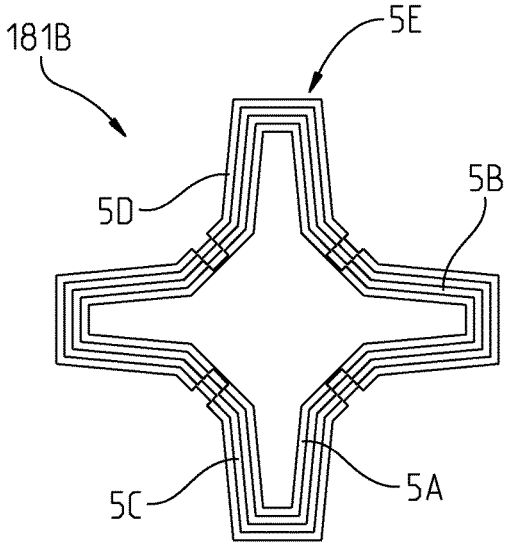

Referring to FIGS. 21A and 21B, a telescoping structure is shown in an extended mode 181A and a retracted or collapsed mode 181B. The telescoping structure is formed of fractal sections 5A, 5B, 5C, 5D, 5E, and 5F which telescope out in an extended mode 181A. Each fractal section can either be made of the same fractal design or it can be designed to create a different resonant or reflecting response than another fractal section. The fractal sections collapse into a housing 184 which can be placed on a floating structure (including the life raft 175 of FIG. 19, 20) or another structure such as one which is towed or flown in the air.

Figure 22:
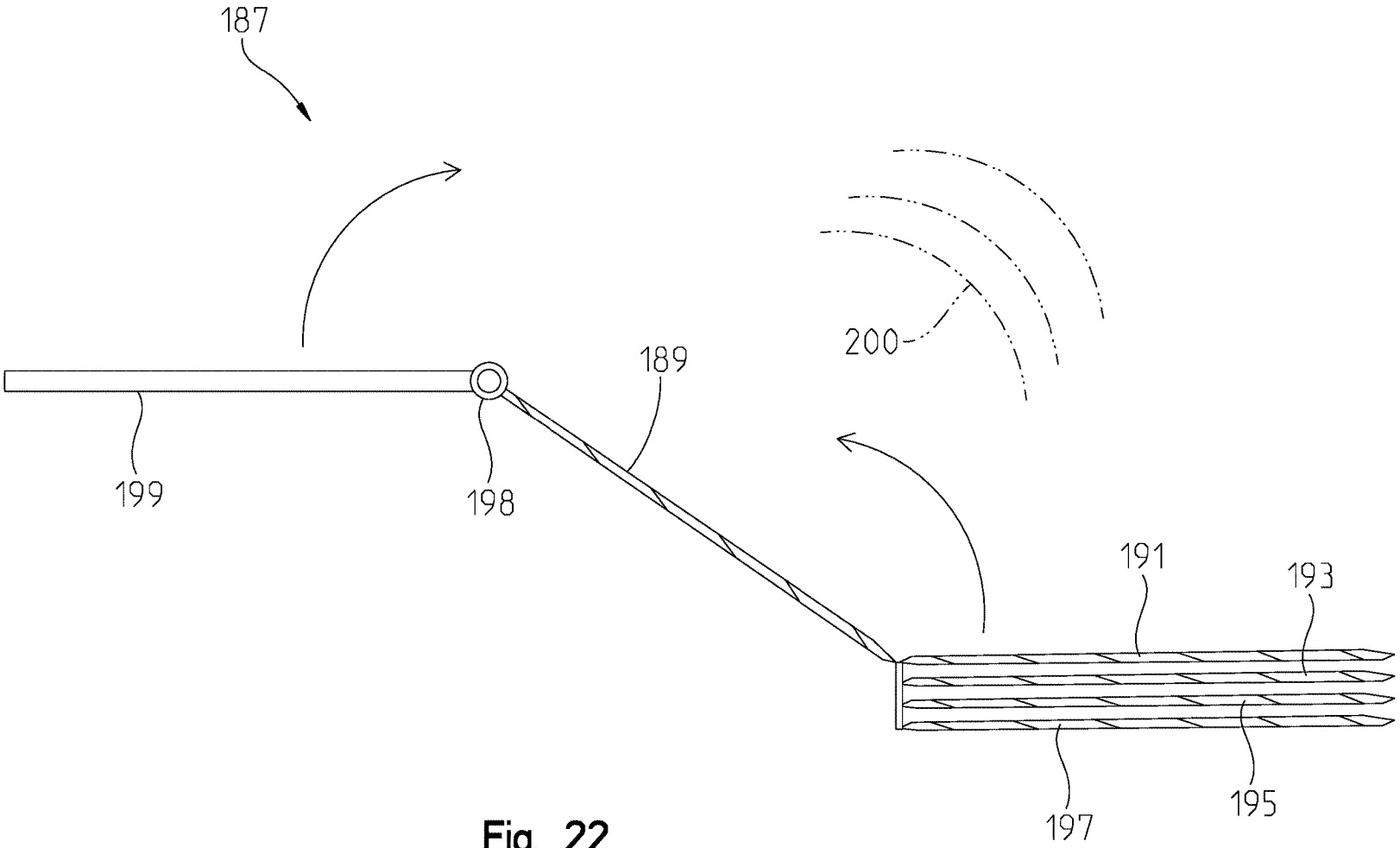
FIG. 22 shows an exemplary IS structure formed of a plurality of IS blankets formed in accordance with one embodiment of the invention.

Referring to FIG. 22 a magazine or book type of IS structure 187 comprising a plurality of IS blankets 189, 191, 193, 195, and 197 are shown which rotate around an axis defined by a hinge or rotatable coupling structure attached to an end of each of the plurality of IS blankets 189, 191, 193, 195, and 197. Each plurality of IS blankets can be designed with a different fractal so as to produce a different reflected or resonant wave energy response. A cover can be attached to one or more of the IS blankets at a hinge point 199 to provide a structure to cover one or more of the plurality IS blankets when they are rotated away from a first position. Both sides of the IS blankets can have fractals deposited on them.

Referring to FIG. 22, an alternative embodiment of this figure can include an exemplary IS system 187 for activating or using different radiation signature pattern of a blanket or multiple blankets comprising a plurality of fractal pattern groups 189, 191, 193, 195, and 197. The fractal pattern groups are each designed to resonate or radiate a specific response based on a different EM or acoustic emission source such that each fractal group emits a radiated or resonance emission 200 of a wavelength in substantially the same range as the normally reflected emissions of a vessel or structure which is desired to be detected by an EM or acoustic radiation transmitter and detection source. In this example, the radiated or resonance emissions 200 of the blanket has a maximum radiated or resonance radiation intensity greater than said normally reflected emissions of said vessel and a minimum radiation intensity of at least equal to said normally radiated emissions of said vessel or structure. A hinge 198 is shown which enables a non-radiating structure to be rotated to cover at least a portion of one or more of the fractal pattern groups 189, 191, 193, 195, or 197.

Figure 23:
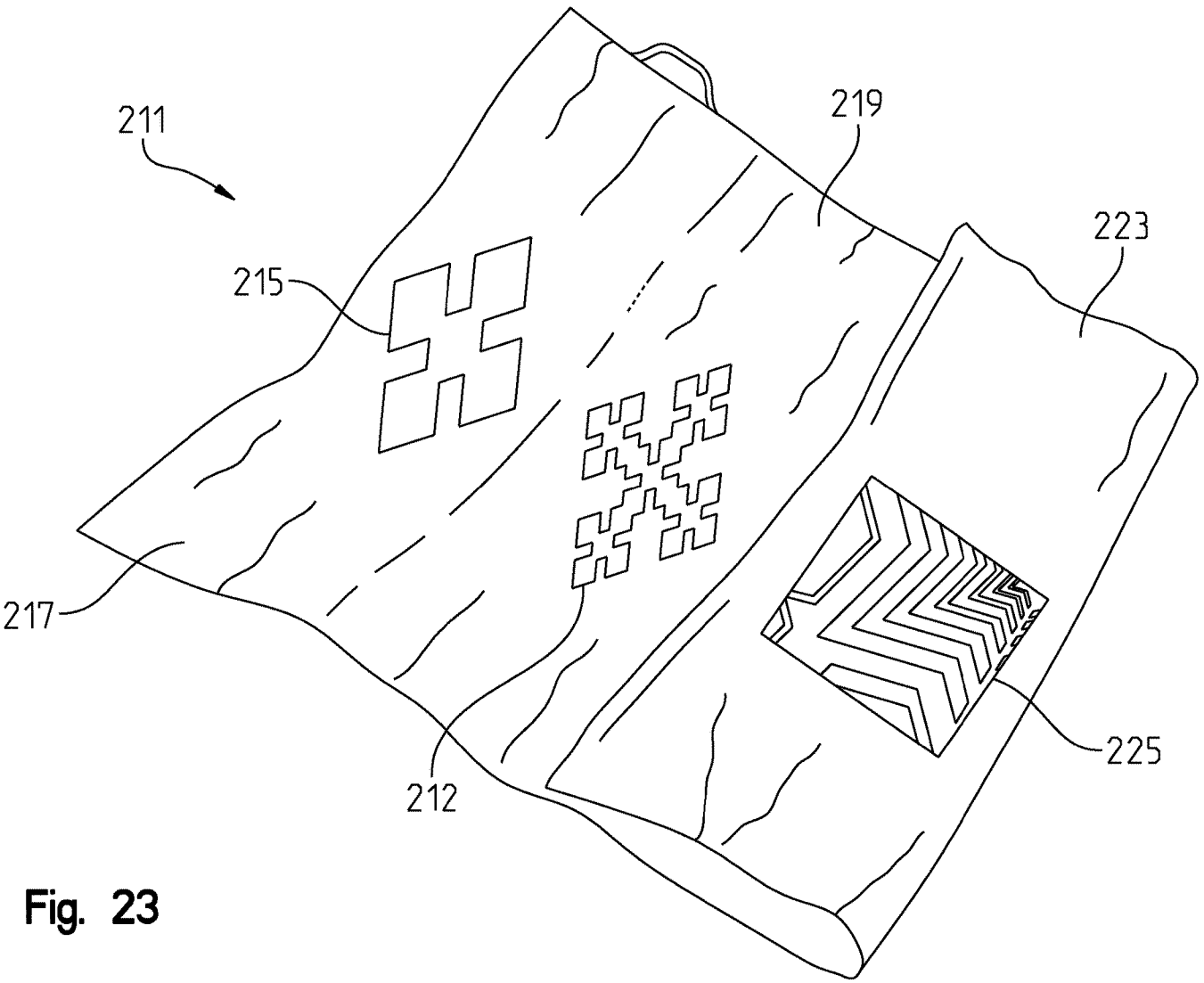
FIG. 23 shows a foldable IS blanket system comprising a plurality of IS blanket sections in accordance with one embodiment of the invention.

FIG. 23 shows a foldable IS blanket system 211 comprising a plurality of IS blanket sections 217, 219, 223 sewn or coupled together side by side which have fractal antennas 215, 212, and 225 (e.g., such as described herein) respectively attached to each blanket section. The foldable IS blanket system 211 can have different coatings or colors which are adapted to reflect different light frequencies such as orange, red, and yellow or different IR frequencies. The plurality of blanket sections 217, 219, 223 can be folded on top of each other to permit exhibiting all of the blanket sections, some of them, or only one of the blanket sections. Both sides of the blanket sections 217, 219, 223 can have fractal antennas attached to them. (not shown)

Figure 24:
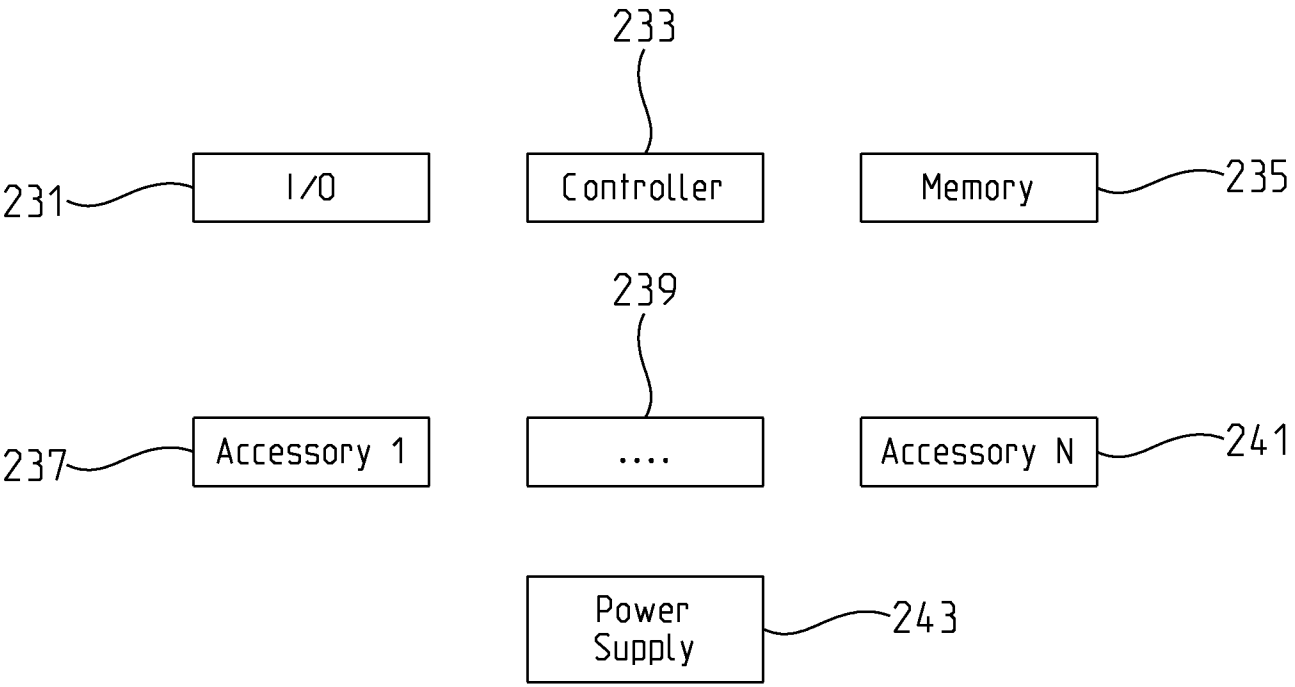
FIG. 24 shows a block diagram of system components provided with an IS system such as described herein.

Referring to FIG. 24, an IS system such as described herein (e.g., FIG. 1) is shown with an embodiment which further includes a controller 233 which is coupled to an input/output (I/O) section 231 and a memory section 235. The I/O section 231, controller 233, and memory section 235 can further be coupled to a plurality of accessories 237, 239, 241 which can include a radio section for receiving radio inputs for activating operations controlled by the controller 233. Alternatively, the I/O section 231 can be coupled via a wire or fiber optic cable (not shown) which is run along a tow cable (not shown) for receiving signals from the tow vehicle or vessel. A power supply 243 can also be provided for feeding power to various components.

Figure 25:
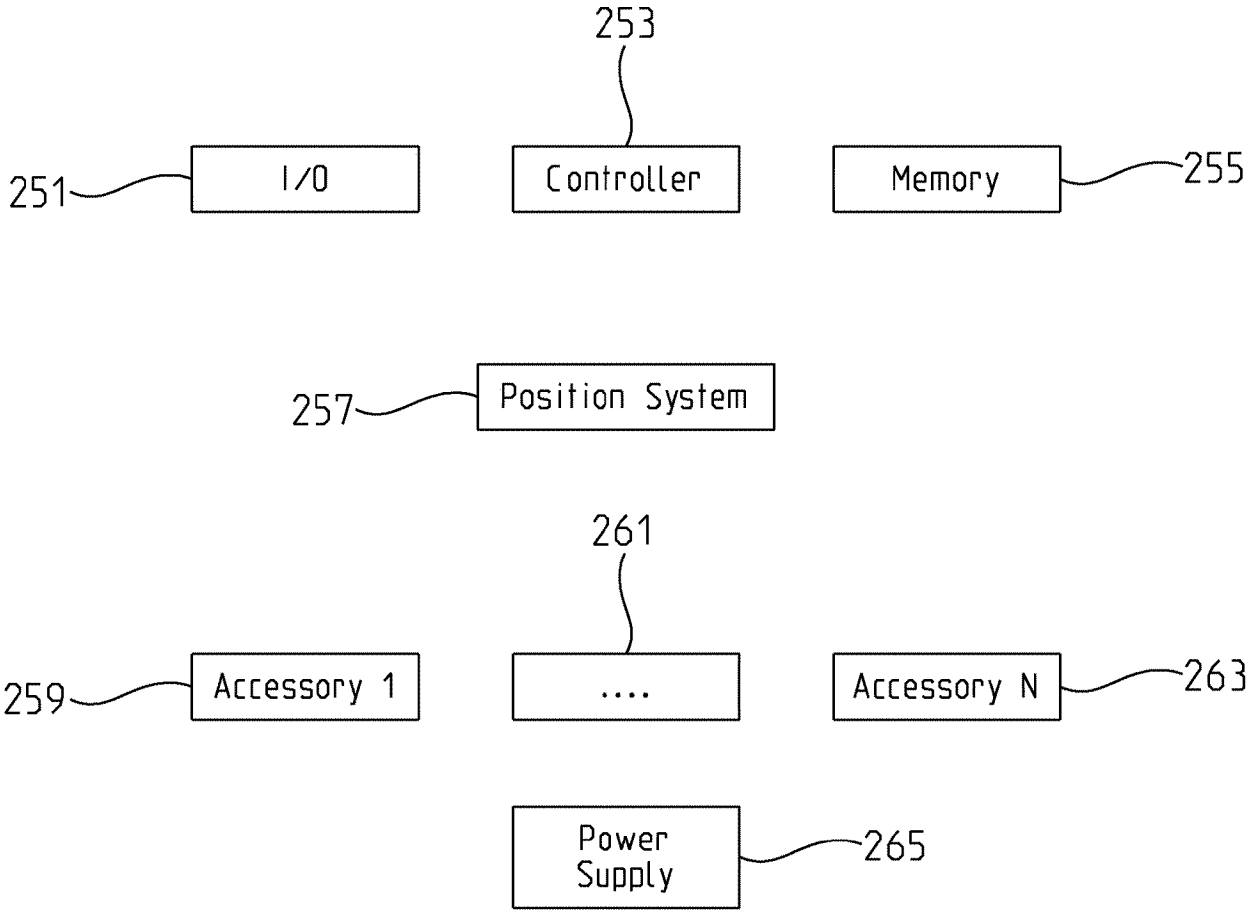
FIG. 25 shows an alternate embodiment of an invention with a different block diagram of system components provided with an alternative embodiment of an IS system such as described herein.

FIG. 25 shows an IS system such as described herein (e.g., FIG. 1) which can have an embodiment which further includes a controller 253 which is coupled to an input/output (I/O) section 251 and a memory section 255. The I/O section 251, controller 253, and memory section 255 can further be coupled to a plurality of accessories 259, 261, 263 which can include a radio section for receiving radio inputs for activating operations controlled by the controller 233 as well as a position system for determining a location of the IS system. Alternatively, the I/O section 251 can be coupled via a wire or fiber optic cable (not shown) which is run along a tow cable (not shown) for receiving signals from the tow vehicle or vessel. A power supply 265 can also be provided for feeding power to various components.

Figure 26:
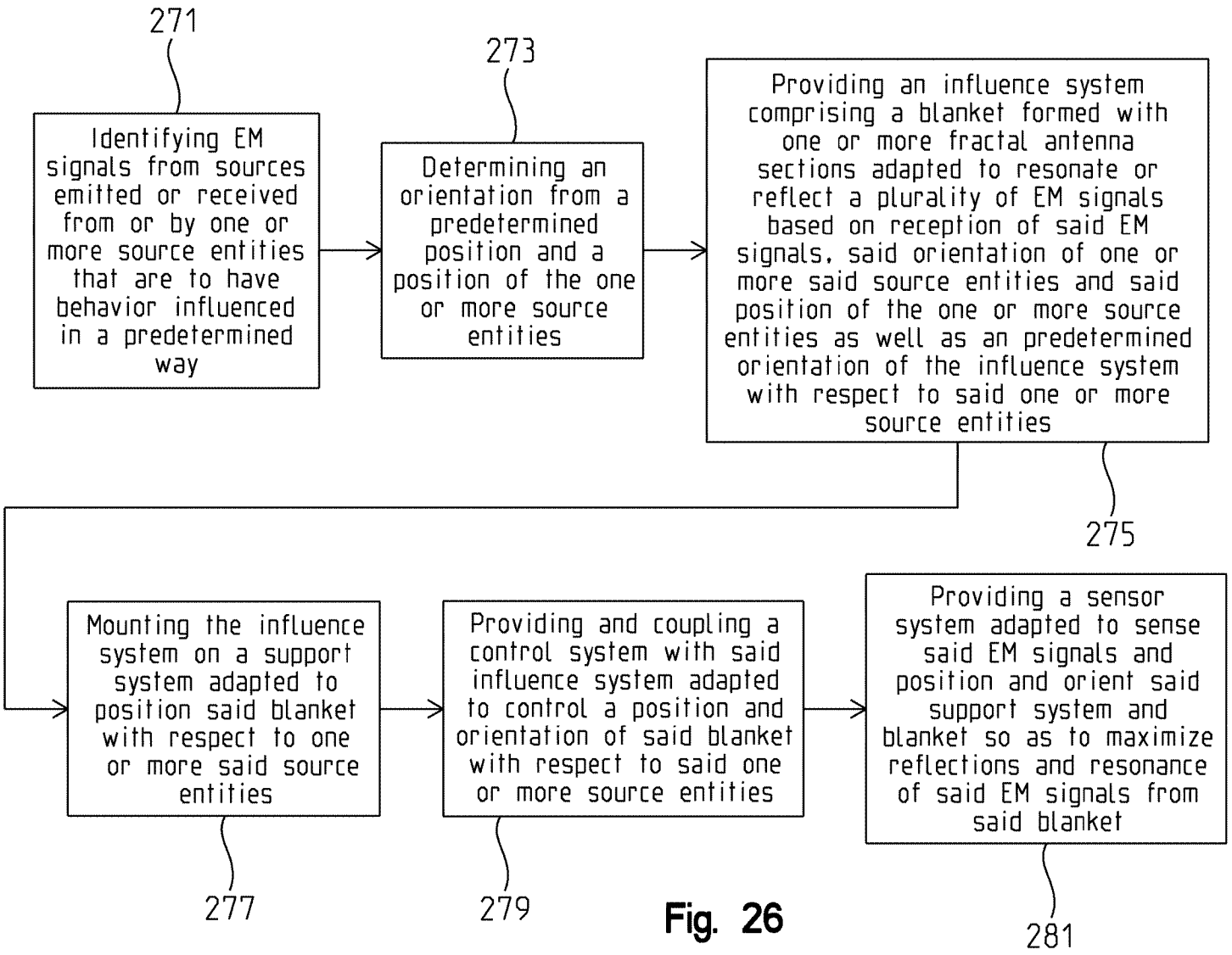
FIG. 26 shows a method associated with one embodiment of the invention.

FIG. 26 shows a method associated with one embodiment of the invention. Step 271 comprises identifying EM signals from sources emitted or received from or by one or more source entities that are to have behavior influenced in a predetermined way. Step 273 comprises determining an orientation from a predetermined position and a position of the one or more source entities. Step 275 comprises providing an influence system comprising a blanket formed with one or more fractal antenna sections adapted to resonate or reflect a plurality of EM signals based on reception of said EM signals, said orientation of one or more said source entities and said position of the one or more source entities as well as a predetermined orientation of the influence system with respect to said one or more source entities. Step 277 comprises mounting the influence system on a support system adapted to position said blanket with respect to one or more said source entities. Step 279 comprises providing and coupling a control system with said influence system adapted to control a position and orientation of said blanket with respect to said one or more source entities. Step 281 comprises providing a sensor system adapted to sense said EM signals and position and orient said support system and blanket so as to maximize reflections and resonance of said EM signals from said blanket.

Figure 27:
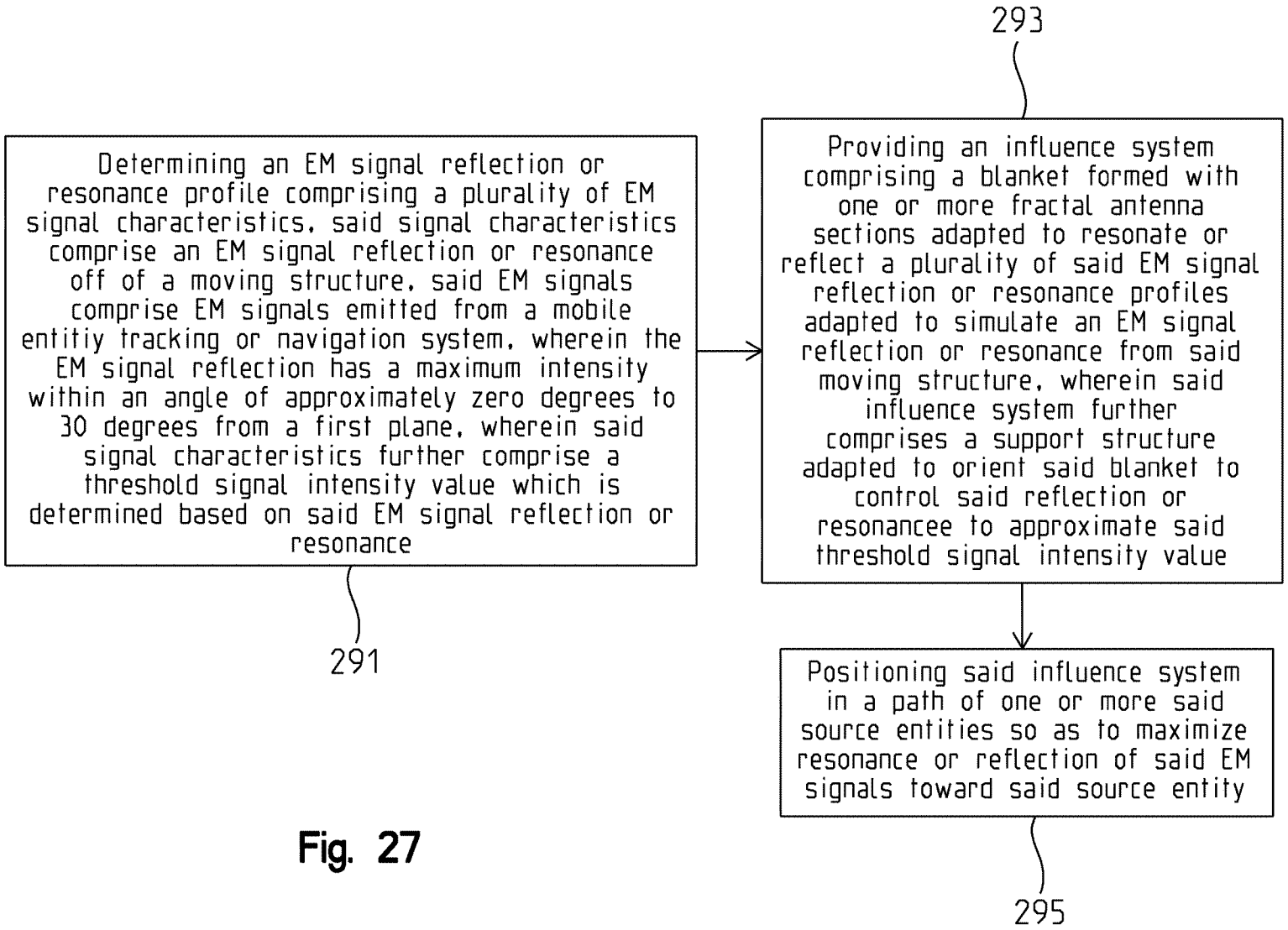
FIG. 27 shows an alternative embodiment of a method associated with the invention.

Referring to FIG. 27, step 291 includes determining an EM signal reflection or resonance profile comprising a plurality of EM signal characteristics, said signal characteristics comprise an EM signal reflection or resonance off of a moving structure, said EM signals comprise EM signals emitted from a mobile entity tracking or navigation system, wherein the EM signal reflection has a maximum intensity within an angle of approximately zero degrees to 30 degrees from a first plane, wherein said signal characteristics further comprise a threshold signal intensity value which is determined based on said EM signal reflection or resonance. Step 293, providing an influence system comprising a blanket formed with one or more fractal antenna sections adapted to resonate or reflect a plurality of said EM signal reflection or resonance profiles adapted to simulate an EM signal reflection or resonance from said moving structure, wherein said influence system further comprises a support structure adapted to orient said blanket to control said reflection or resonance to approximate said threshold signal intensity value. Step 295, positioning said influence system in a path of one or more said source entities so as to maximize resonance or reflection of said EM signals towards said source entity.

Alternative embodiments of the invention can include a counter weight system that can include flotation units which can be adjustably filled with water to provide ballast to provide sufficient counterweight to permit the lifting structure to provide sufficient adjustable force to position the blanket at a desired position. The alternative embodiment support section can include a position and orientation sensor or several such sensors which permit the controller and software either on the controller or on a remote control station which communicates with the controller through the I/O system. A solar panel can also be provided to provide power or an alternate power system can be provided which could include a towed generator system which has an apparatus for converting movement of water past a mechanical apparatus such as a screw or propeller system into electric power for providing power to the support section and other systems on board the IS platform.

Another alternative embodiment can include an active emitter that could also be attached to a support structure for an IS system embodiment with an ability to emit different wave energies such as acoustic or energy in a variety of EM spectrums such as RF, visible light, infra-red, or other desirable spectrum. The active emitter could be used to interact with wave energy from an EM system of interest so as to alter phase or directivity of the wave energy which is being resonated or reflected from the IS's blanket 5.

Additional systems that could be coupled to the support structure or blanket include sonar emitters, pyrotechnic devices such as flares, reflective Mylar or plastic structures. These additional systems can be adapted to reflect or resonate different EM spectrum or acoustic energy or be further adapted to emit specific recorded sounds or EM spectrum such as certain types of ship or mobile system sounds, EM signatures, geologic sounds, or warning sounds emitted from dolphins or other marine mammals indicating a predator is present in order to warn off or discourage such mammals from coming into proximity with the blanket or support structure. These EM or acoustic systems can be directional and can also be raised or lowered from the support structure or blanket to desired heights or depths in order to provide maximum desired effect based on entities which are the subject of the IS desired effects or outcomes. An additional system, such as an acoustic or RF emission system which is raised above sea level or lowered into the ocean can also have measuring equipment for measuring environment surrounding the additional system such as a heat or infrared sensor adapted to sense objects on the surface or in the air. Additional systems can also include a temperature or acoustic measuring sensor such as a microphone or piezoelectric transducer adapted to emit high intensity sounds and receive reflected sounds in the water.

Another embodiment can include a rocket or ejector system which rapidly repositions the support structure or blanket. An example can include a proximity sensor which detects a structure or entity of interest then rapidly moves the blanket or support structure to include a net system or capture system which is adapted to move the blanket or support structure to interact with a structure or entity of interest which is emitting wave energy including a net system or an RF dipole strip ejector which respectively grapples with or interacts with such a structure or entity of interest.

An inflatable balloon can also be coupled to the blanket or support structure to cause the structure or blanket to rise into the air after a command is received by the controller or I/O system. The balloon can have a relief value which releases lighter than air gasses to cause the balloon to fall.

Another alternative embodiment of the invention can include an IS blanket (e.g., FIG. 1, 5) and support structure that can also have an articulated mechanical structure which can alter contours of the blanket to form different shapes. These shapes can include parabolic shapes or other shapes which provide increased reflective capability towards a particular vector. Actuators can be attached to sections of a semi-rigid blanket to alter the shape of the blanket to produce a desired shape.

An alternative embodiment of the IS system can also be formed with inflation sections which alter the shape of the blanket based on desired energy reflection or resonance profiles. Such sections can include accordion type segments which can pivot on an axis or side in order to provide selected alterations to segments or sections of the blanket in order to position such sections in relation to a wave energy source to adjust a reflected or resonant wave energy in relation to a wave energy source such as a radar or EM tracking system coupled to a mobile structure, vessel or aircraft.

Although the invention has been described in detail with reference to certain preferred embodiments, variations and modifications exist within the spirit and scope of the invention as described and defined in the following claims.

The invention claimed is:

1. An influence system, comprising:

two layer open cell blanket formed with one or more fractal reflective or resonating structures, wherein the fractal reflective or resonating structures are adapted to produce an emitted reflective or resonance signal that approximately matches a target electromagnetic signal reflection or resonance profile comprising a plurality of electromagnetic signal characteristics, said plurality of electromagnetic signal characteristics comprises an electromagnetic signal reflection or resonance signals emitted from a source entity and reflected or resonated off said target entity, wherein the electromagnetic signal reflective or resonance signal has an approximate maximum intensity within an angle of approximately zero degrees to 30 degrees from a first plane defined by a face of the blanket, wherein said target electromagnetic signal reflection or resonance profile further comprises a signal intensity value which is determined based on said electromagnetic signal reflection or resonance from said target by said source entity; and a tow yoke coupled to one end of said blanket comprising a floatation chamber section;

a tow cable adapted to tow said tow yoke and blanket.

2. A system as in claim 1, further comprising a second said two layer open cell blanket, a second tow yoke coupled to said first two layer open cell blanket, and a second tow cable, said second yoke is coupled to said second two layer open cell blanket, wherein said second tow cable is coupled to said second tow yoke.

3. A system as in claim 1, wherein said blanket is formed with air cells.

4. A system as in claim 1, wherein said fractal or resonating structure comprises a Koch Curve based structure adapted to enhance radio frequency electromagnetic energy return.

5. A system as in claim 1, wherein said blanket comprises a dipole chaff to enhance RF return.

6. A system as in claim 1, wherein said blanket further comprises internal longitudinal and lateral stiffeners to provide rigidity to the blanket.

7. A system as in claim 1, further comprising a controller and a gas source coupled with said blanket, wherein said blanket is adapted to be inflated by said gas source which can be activated by said controller when a predetermined electromagnetic frequency or pattern is detected by a communication device.

8. A system as in claim 7, wherein said communication device is mounted on the influence system.

9. A system as in claim 8, wherein said communication device is mounted on another structure, wherein said controller activates said gas source based on a control signal sent to the controller remotely either through a direct connection through a line coupled with the tow cable or by an electromagnetic transceiver not coupled to the blanket to said controller to provide deployment of the blanket.

10. A system as in claim 1, wherein said one or more fractal reflective or resonating structures comprise an array of fractal antenna sections.

11. A system as in claim 1, wherein said one or more fractal reflective or resonating structures comprise irregular but self-similar, repeated fractal-shaped unit sections, which cover an entire plane of the blanket.

12. A system as in claim 1, wherein said one or more fractal reflective or resonating structures comprise a modular array adapted to produce phased and other types of beamforming effects of said emitted reflective or resonance signals in a particular direction or orientation comprising a direction between a first vector and a second vector.

13. A system as in claim 1, wherein said one or more fractal reflective or resonating structures comprise a microstrip antenna adapted to resonate an electromagnetic signal that approximately matches said target electromagnetic signal reflection or resonance profile.

14. A system as in claim 1, wherein said one or more fractal reflective or resonating structures are adapted to resonate an electromagnetic signal that approximately matches a second target electromagnetic signal reflection or resonance profile.

15. A system as in claim 1, wherein said one or more fractal reflective or resonating structures comprise a plurality of phased arrays adapted to resonate or reflect a plurality of different said emitted reflective or resonance signals.

16. A system as in claim 1, wherein said blanket comprises an array of antennas comprising said one or more fractal reflective or resonating structures and at least one active electromagnetic emitter antenna, wherein relative phases of respective signals produced by resonance or reflectance from said one or more fractal reflective or resonating antennas is coupled with electromagnetic energy produced by said active emitters where signals produced from said at least one active electromagnetic emitter and said one or more fractal reflecting or resonating structures are combined and are varied in such a way that an effective radiation pattern of the array of antennas is reinforced in a desired direction and suppressed in undesired directions.

17. A system as in claim 1, wherein said one or more fractal reflective or resonating structures comprise an array of patch antennas in a phased array of antennas adapted to produce beamforming of said emitted or reflective signal.

18. A system as in claim 1, further comprising an electromagnetic wave energy absorptive cover which can retractably cover said blanket and a retraction and extension system and actuators or motors which provides mechanical force to retract or extend said cover.

19. A system as in claim 18, wherein said retraction and extension system comprises a housing, wire, and pulley.

20. A system as in claim 19, wherein a said housing comprises a spring loading retraction and extension system so as to retract said cover when said cover is unlatched from a latching point when said cover is in a deployed position covering the blanket.

21. A system as in claim 18, wherein said cover is formed with wave energy or radar absorptive material, said cover is further formed of a material which presents a neutral infrared emission so that it does not radiate infrared and is further adapted to be non-reflective in a visible light spectrum.

22. A system as in claim 1, further comprising a housing and an extension system, wherein said blanket is releasably stored in said housing and is adapted to be extended by said extension system.

23. A system as in claim 22, further comprising a retraction system adapted to retract said blanket into said housing.

24. A system as in claim 22, wherein said extension system is an energetic device adapted to extend said blanket upon activation.

25. A system as in claim 1, further comprising a support section adapted to support said blanket and orient said blanket in at least one predetermined position relative to a reference plane.

26. A system as in claim 25, wherein said support section comprises flotation sections adapted to raise or lower the support section.

27. A system as in claim 25, wherein said support section further comprises actuators or motor systems adapted to selectively orient different sections of said support section, and thereby orient different sections of said blanket in different orientations.

28. A system as in claim 26, wherein said flotation section comprises a hydrofoil assembly adapted to raise and stabilize said blanket when said system is moving over a body of water.

29. A system as in claim 25, further comprising a steering section adapted to steer the system in a body of water.

30. A system as in claim 25, wherein said support section comprises a first and second tilt and pivoting hinge structure adapted to pivot or angle said blanket along a plurality of axis comprising a first and second axis.

31. A system as in claim 1, further comprising a submersible system adapted to tow said blanket via said tow cable and tow yoke.

32. A system as in claim 1 further comprising an unmanned aerial vehicle system adapted to tow said blanket via said tow cable and tow yoke.

33. A system as in claim 32, wherein said unmanned aerial vehicle comprises a vehicle adapted to be loaded and ejected from a tube mounted launching system.

34. A system as in claim 1, further comprising a first lifting structure adapted to lift said blanket into the air above a surface to a desired height as it is towed.

35. A system as in claim 34, wherein said first lifting structure comprises a parasail.

36. A system as in claim 34 further comprising a second lifting structure attach to a section of said blanket opposing a section said first lifting structure is attached thereto.

37. A system as in claim 34, further comprising a second tow cable attached to said tow yoke, said tow cable and said second tow cable are adapted to maintain a predetermined orientation of said blanket.

38. A system as in claim 1, further comprising a life raft structure coupled to said tow yoke via said tow cable.

39. A system as in claim 38, further comprising a life raft housing, said life raft and said blanket are stored within and a life raft assembly parachute coupled to said housing, said life raft and blanket are adapted to be released by said life raft housing upon ejection from an aircraft or moving structure.

40. A system as in claim 39, wherein said life raft parachute comprises said tow yoke coupled to said blanket.

41. A system as in claim 1, further comprising a telescoping structure having a plurality of extension or retraction modes, wherein at least a part of said telescoping structure is formed with a plurality of said blankets.

42. A system as in claim 1, further comprising a plurality of blankets adapted to be selectively covered or uncovered by a control mechanism, wherein each said blanket is adapted to produce a different said emitted reflective or resonance signal that each approximately matches a different said target electromagnetic signal reflection or resonance profile.

43. A system as in claim 1, further comprising a plurality of components, said plurality of components comprising a controller, an input and output system, and a memory section, wherein said plurality of components are adapted to control a plurality of accessories mounted in proximity to said blanket.

* * * * *